US005515153A

United States Patent [19]

Tokunoh

[11] Patent Number: 5,515,153

[45] Date of Patent: May 7, 1996

[54] IMAGE-FORMING APPARATUS WITH AN AUTOMATIC-DOCUMENT FEEDER HAVING A DOCUMENT-TRANSPORTING BELT

[75] Inventor: Yoshiaki Tokunoh, Kanagawa, Japan

[73] Assignee: Kabushiki Kaisha Toshiba, Kawasaki, Japan

[21] Appl. No.: 332,043

[22] Filed: Nov. 1, 1994

[30] Foreign Application Priority Data

Dec. 29, 1993 [JP] Japan ..... 5-349619

[51] Int. Cl.[6] ..... G03G 21/00

[52] U.S. Cl. ..... 355/320; 355/313

[58] Field of Search ..... 355/308, 309, 355/313, 320, 321

[56] References Cited

U.S. PATENT DOCUMENTS

| | | | |
|---|---|---|---|
| 5,038,182 | 8/1991 | Tanimoto | 355/320 |
| 5,347,351 | 9/1994 | Morita et al. | 355/313 |

*Primary Examiner*—William J. Royer
*Attorney, Agent, or Firm*—Foley & Lardner

[57] ABSTRACT

An image-forming apparatus includes a platen on which an original having an original image is placed, an automatic-document feeder, arranged on the platen, for transporting the original from an original receiving portion onto the platen and for discharging the original from the platen, an exposure lamp for exposing the platen to form a reflected light. The reflected light includes a light reflected by the original when the original is on the platen. Further, the image-forming apparatus includes an image-forming portion for forming a copy image on an image-bearing member on the basis of the reflected light. The automatic-document feeder includes a mechanism for picking up the original placed on the original receiving portion; a document-transporting belt for transporting the original picked up by the mechanism by contacting an opposite surface of the original which does not face the platen so as to position the original on the platen; a control system for determining that the original picked up has an image on the opposite surface; and a driving mechanism for driving the document-transporting belt to transport the original so that a first specific area and a second specific area are formed in the document-transporting belt, the first specific area contacting the opposite surface when the control system determines that the original has an image on the opposite surface, the second specific area contacting the opposite surface when the original does not have an image on the opposite surface.

24 Claims, 20 Drawing Sheets

Magnification Ratio = 120%

Magnification Ratio = 100%

IMAGE-FORMING APPARATUS WITH AN AUTOMATIC-DOCUMENT FEEDER HAVING A DOCUMENT-TRANSPORTING BELT

BACKGROUND OF THE INVENTION

1. Field of the Invention

The present invention relates to an image-forming apparatus with an automatic-document feeder which has a document-transporting belt for transporting an original during contacting each other.

2. Description of the Related Art

Recently, an automatic-document feeder used with an image-forming apparatus such as on a plain paper copying machine, as, for example, disclosed in Japanese Patent Publication (Kokai) No. 4-23752, has had a document-transporting belt for transporting an original onto a platen of the image-forming apparatus and for positioning it. The document-transporting belt, generally, is made from a high-friction material, and transports an original by its frictional force. Thus, if an opposite surface of an original which contacts the document-transporting belt has an image, the document-transporting belt gets dirty easily. Moreover, it is necessary to utilize a resource effectively in consideration of an environmental problem, as a result, an original which has an image on two-sides is increasing. When the original transported has an image on two-sides and both the surfaces are set on the platen continuously, the images of both the surfaces may attach to the document-transporting belt because both the surfaces contact the document-transporting belt. Therefore, the document-transporting belt gets dirty more easily.

Such a dirty document-transporting belt makes a copy image formed on an image-bearing material, e.g., a paper sheet dirty in many cases. For example, when the paper sheet is bigger than the original, and an original image reduced is smaller than the paper sheet, the copy image of the dirty document-transporting belt is formed in the circumference of the paper sheet. If an original is a sheet of tracing paper which is a high transmittance sheet, the copy image of the dirty document-transporting belt is formed through the original.

For these reasons, a document-transporting belt has to be cleaned frequently and has to be renewed if a document-transporting belt is too dirty.

SUMMARY OF THE INVENTION

It is therefore an object of the present invention to provide an improved image-forming apparatus.

It is a particular object of the present invention to provide an image-forming apparatus which prevents a copy image from getting worse even if a document-transporting belt of an automatic-document feeder is dirty.

It is another object of the present invention to provide an improved automatic-document feeder.

Another object of the present invention is to provide an improved automatic-document feeding method.

It is another object of the present invention to provide an improved image-forming method.

In accordance with one aspect of the present invention, the foregoing objects, among others, are achieved by providing an automatic-document feeder for transporting an original from an original receiving portion to a scanned area in which the original is scanned. The automatic-document feeder includes means for picking up the original placed on the original receiving portion; and a document-transporting belt, arranged so as to cover the scanned area, for transporting the original picked up by the picking-up means while contacting an opposite surface of the original which does not face the scanned area so as to position the original on the scanned area. Furthermore, the automatic-document feeder includes means for determining that the original picked up has an image on the opposite surface; and means for driving the document-transporting belt to transport the original so that a first specific area and a second specific area are formed on the document-transporting belt, the first specific area contacts the opposite surface when the determining means determines that the original has an image on the opposite surface, the second specific area contacts the opposite surface when the original does not have an image on the opposite surface.

In accordance with another aspect of the present invention, there has been provided an image-forming apparatus which includes a platen on which an original having an original image is placed. The platen is made from transparent material. An image-forming apparatus includes an automatic-document feeder, arranged on the platen, for transporting the original from an original receiving portion onto the platen and for discharging the original from the platen. An image-forming apparatus also includes an exposure lamp for exposing the platen to form a reflected light. The reflected light includes a light reflected by the original when the original is on the platen. Further, an image-forming apparatus includes an image-forming portion for forming a copy image on an image-bearing member on the basis of the reflected light. The automatic-document feeder includes a mechanism for picking up the original placed on the original receiving portion; a document-transporting belt, arranged so as to cover the platen, for transporting the original picked up by the mechanism while contacting an opposite surface of the original which does not face the platen so as to position the original on the platen; a control system for determining that the original picked up has an image on the opposite surface; and a driving mechanism for driving the document-transporting belt to transport the original so that a first specific area and a second specific area are formed on the document-transporting belt, the first specific area contacting the opposite surface when the control system determines that the original has an image on the opposite surface, the second specific area contacting the opposite surface when the original does not have an image on the opposite surface.

In accordance with another aspect of the present invention, there has been provided an automatic-document feeding method for transporting an original from an original receiving portion to a scanned area in which the original is scanned. The automatic-document feeding method includes the steps of picking up an original placed on an original receiving portion, and determining that the original picked up has an image on an opposite surface. Also, the automatic-transporting method includes the steps of transporting the original picked up by using a document-transporting belt so as to position the original on the scanned area, the document-transporting belt is arranged so as to cover the scanned area and contacting the opposite surface during transporting the original, and driving the document-transporting belt to transport the original so that a first specific area and a second specific area are formed on the document-transporting belt, the first specific area contacts the opposite surface when the original has an image on the opposite surface, the second specific area contacts the opposite surface when the original does not have an image on the opposite surface.

In accordance with still another aspect of the present invention, there has been provided an image-forming method which includes the steps of picking up an original placed on an original receiving portion, determining that the original picked up has an image on an opposite surface, and transporting the original picked up by using a document-transporting belt so as to position the original on a platen made from transparent material. The document-transporting belt is arranged so as to cover the scanned area and contacting the opposite surface during transporting the original. Furthermore, the image-forming method includes the step of driving the document-transporting belt to transport the original so that a first specific area and a second specific area are formed on the document-transporting belt. The first specific area contacts the opposite surface when the original has an image on the opposite surface, and the second specific area contacts the opposite surface when the original does not have an image on the opposite surface. Also, the image-forming method includes the steps of exposing the platen to form a reflected light, the reflected light includes a light reflected by the original when the original is on the platen, and forming a copy image on an image-bearing member on the basis of the reflected light.

BRIEF DESCRIPTION OF THE DRAWINGS

A more complete appreciation of the present invention and many of the attendant advantages thereof will be readily obtained as the invention becomes better understood by reference to the following detailed description, when considered in connection with the accompanying drawings, wherein.

DETAILED DESCRIPTION OF THE PREFERRED EMBODIMENTS

Figure 1:
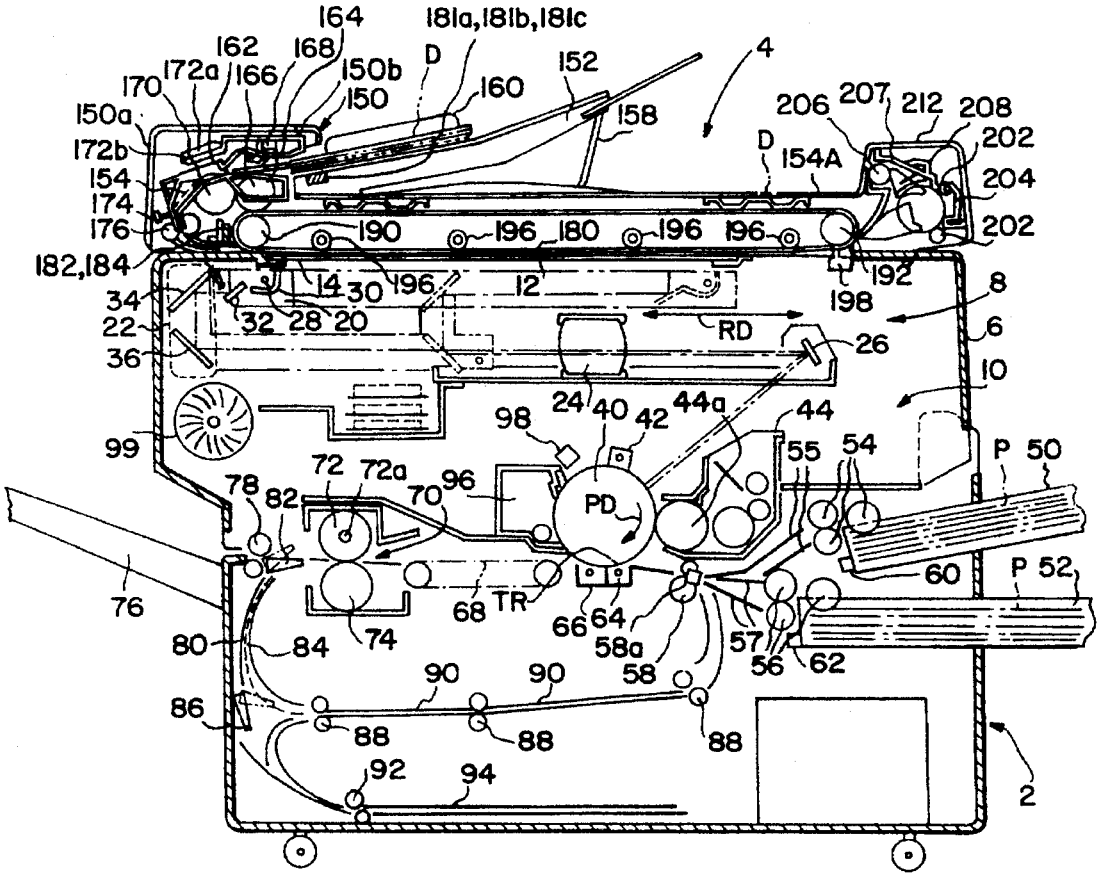
FIG. 1 is a sectional view of the image-forming apparatus with the automatic-document feeder of a first embodiment of the present invention.

FIG. 1 shows a copying machine 2 as an image-forming apparatus according to a first embodiment of the present invention, with an automatic-document feeder 4. Copying machine 2 includes a copying machine housing 6, an image-scanning portion 8 at the upper portion thereof, and an image-forming portion 10 at the central portion thereof.

A platen 12 which is a transparent material such as glass, is fixed on the upper surface of image-scanning portion 8. Automatic-document feeder 4 includes a hinge. The hinge supports automatic-document feeder 4 so as to be removable and be positioned to cover or not cover platen 12. A scale 14 which is useful for indicating a position for an original to be placed and for positioning an original D, is fixed at one end of platen 12 along the longitudinal direction thereof. The lower surface of the original D positioned in this way is in an exposure area. Document-detecting sensor 16 (shown in FIG. 2) is arranged near scale 14 to detect a trailing edge of a sheet of original D when automatic-document feeder 4 transports the sheet of original D. Document-detecting sensor 16 is used for positioning a sheet of original D on platen 12.

Original D placed on platen 12 is scanned for image exposure by image-scanning portion 8. Image-scanning portion 8 includes a first carriage 20, a second carriage 22, a lens block 24 for focusing the light from original D (either unmagnified, magnified or reduced), and mirror 26. First carriage 20 includes an exposure lamp 28, a reflector 30 for reflecting the light from exposure lamp 28 to platen 12 and a mirror 32. Second carriage 22 includes a mirror 34 and a mirror 36. When image-scanning portion 8 scans original D, the lower surface of original D is exposed by exposure lamp 28 while first carriage 20 and second carriage 22 reciprocate in the direction indicated by an arrow RD along the under surface of platen 12. In this case, second carriage 22 moves at a speed half that of first carriage 20 in order to maintain a fixed optical path length.

A reflected light beam from original D scanned by image-scanning portion 8 is reflected by mirror 32, mirror 34 and mirror 36, transmitted through lens block 24 and then reflected by mirror 26 to be directed on a photosensitive drum 40 in image-forming portion 10. Thus, an electrostatic latent image of original D is formed on the surface of photosensitive drum 40.

Image-forming portion 10 forms an image corresponding to the reflected light image and includes photosensitive drum 40. Photosensitive drum 40 is rotated by a motor (not shown) in the direction indicated by an arrow PD so that its surface is wholly charged first by a main charger 42 so that a potential of the circumferential surface is preferably about +700 V to +800 V. The image of original D is projected on the charged surface of photosensitive drum 40 by slit exposure, forming the electrostatic latent image on the surface.

The electrostatic latent image is developed into a visible image which is a toner image by a developing roller 44*a* of a developing unit 44 using a two component developing agent including toner. The average diameter of the toner is about 6 μm to 15 μm. The toner is previously charged at about −10 μC/g to −40 μC/g. A bias voltage provided to developing roller 44*a* is about −500 V.

Each paper sheet P as an image record medium is delivered one by one from one of an upper paper cassette 50 and a lower paper cassette 52. Paper sheets P stacked in upper paper cassette 50 are transported to an aligning roller pair 58 by transporting rollers 54 while guide members 55 guide paper sheet P. Paper sheets P stacked in lower paper cassette 52 are transported to aligning roller pair 58 by transporting rollers 56 while guide members 57 guide paper sheet P. Paper sheet P is detected by an aligning sensor 58*a*. Then, each paper sheet P is delivered to a transfer region TR by aligning roller pair 58, timed to the formation of the visible image.

Upper paper cassette 50 and lower paper cassette 52 are removably attached to the lower right end portion of housing 6, and can be alternatively selected by operation on a control panel which will be described later. Upper paper cassette 50 and lower paper cassette 52 are provided, respectively, with cassette size detecting switches 60 and 62 (only one shown) which detect the selected cassette size. Detecting switches 60 and 62 are each formed by a plurality of microswitches which are turned on or off in response to insertion of cassettes of different sizes.

Paper sheet P delivered to transfer region TR comes into intimate contact with the surface of photosensitive drum 40, in the space between a transfer charger 64 and photosensitive drum 40. As a result, the toner image on photosensitive drum 40 is transferred to paper sheet P by the agency of transfer charger 64. After the transfer, paper sheet P is separated from photosensitive drum 40 by a separation charger 66 and transported by a conveyor belt 68. Thus, paper sheet P is delivered to a fixing unit 70 arranged at the terminal end portion of conveyor belt 68. Fixing unit 70 includes a heat roller 72 which has a heater lamp 72a and a pressure roller 74 which is arranged in contact with heat roller 72. As paper sheet P passes a nip portion between heat roller 72 and pressure roller 74, the transferred image is fixed on paper sheet P. After the fixation, paper sheet P is discharged into a tray 76 outside housing 6 by a rotation of an exit roller pair 78.

If paper sheet P, however, is to have a two-sided copying or a multiple copying, paper sheet P is sent, instead of being discharged directly to tray 76 through exit roller pair 78, into a retransporting path 80 by means of a gate unit 82. Gate unit 82 is arranged between fixing unit 70 and exit roller pair 78. Paper sheet P transported by gate unit 82 is guided by a guide 84 and transported to a gate unit 86. When paper sheet P is to have the multiple copying, gate unit 86 directs paper sheet P to aligning roller pair 58 through transporting roller pairs 88 and transporting guides 90. When paper sheet P is to have the two-sided copying, gate unit 86 guides paper sheet P to a reverse roller pair 92 and a reverse guide 94. The length of reverse guide 94 is more than the length of the maximum size of original D which copying machine 2 treats. Paper sheet P transported to reverse roller pair 92 is transported in the same direction until the rear end of paper sheet P arrives at reverse roller pair 92. After that, reversing roller pair 92 turns over and paper sheet P is transported in the direction opposite to the direction of transportation before that time and sent to aligning roller pair 58 through transporting roller pairs 88 and transporting guides 90. In this way, paper sheet P is transported to the transfer region again and the multiple copying or the two-sided copying is performed.

After the transfer, moreover, the residual toner on the surface of photosensitive drum 40 is removed by a cleaner 96. Thereafter, a residual latent image on photosensitive drum 40 is erased by a discharge lamp 98 to restore the initial state. A cooling fan 99 for preventing the temperature inside housing 6 from rising is arranged at an upper-left portion of fixing unit 70.

Figure 2:
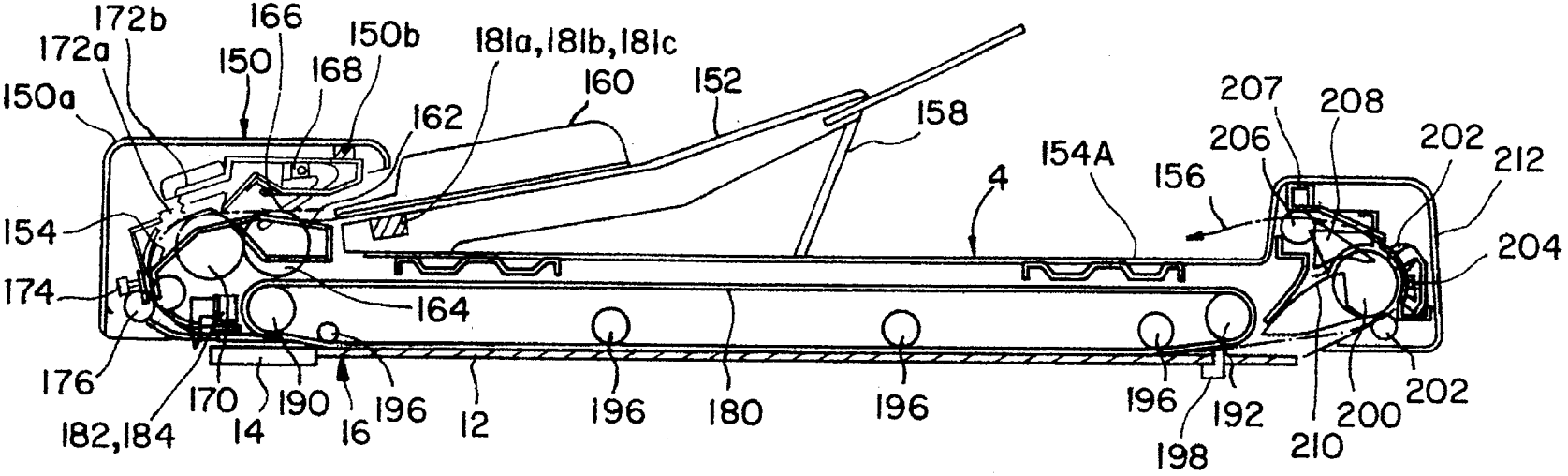
FIG. 2 is a sectional view of the automatic-document feeder shown in FIG. 1.

Automatic-document feeder 4, as shown in FIG. 2, includes a housing 150 and a tray 152 which stacks originals D, and feeds original D from tray 152 through a document-transport path 154 onto platen 12. After original D has been scanned by image-scanning portion 8, automatic-document feeder 4 discharges the sheets of original D to a discharge portion 154A on housing 150 through a document-discharging path 156, so that the original surface is up.

Tray 152 provided on housing 150 is sloped so as to facilitate a picking up operation of the sheet of original D, and may receive, for example, 50 sheets of original D. A support leg 158 is arranged under tray 152 in order to prevent tray 152 from being deflected due to the weight of the sheets of original D. An original guide 160 is slidably arranged on tray 152. Original guide 160 indicates a position at which the sheets of original D are placed, and prevents the sheets of original D from being off-set.

Figure 3:
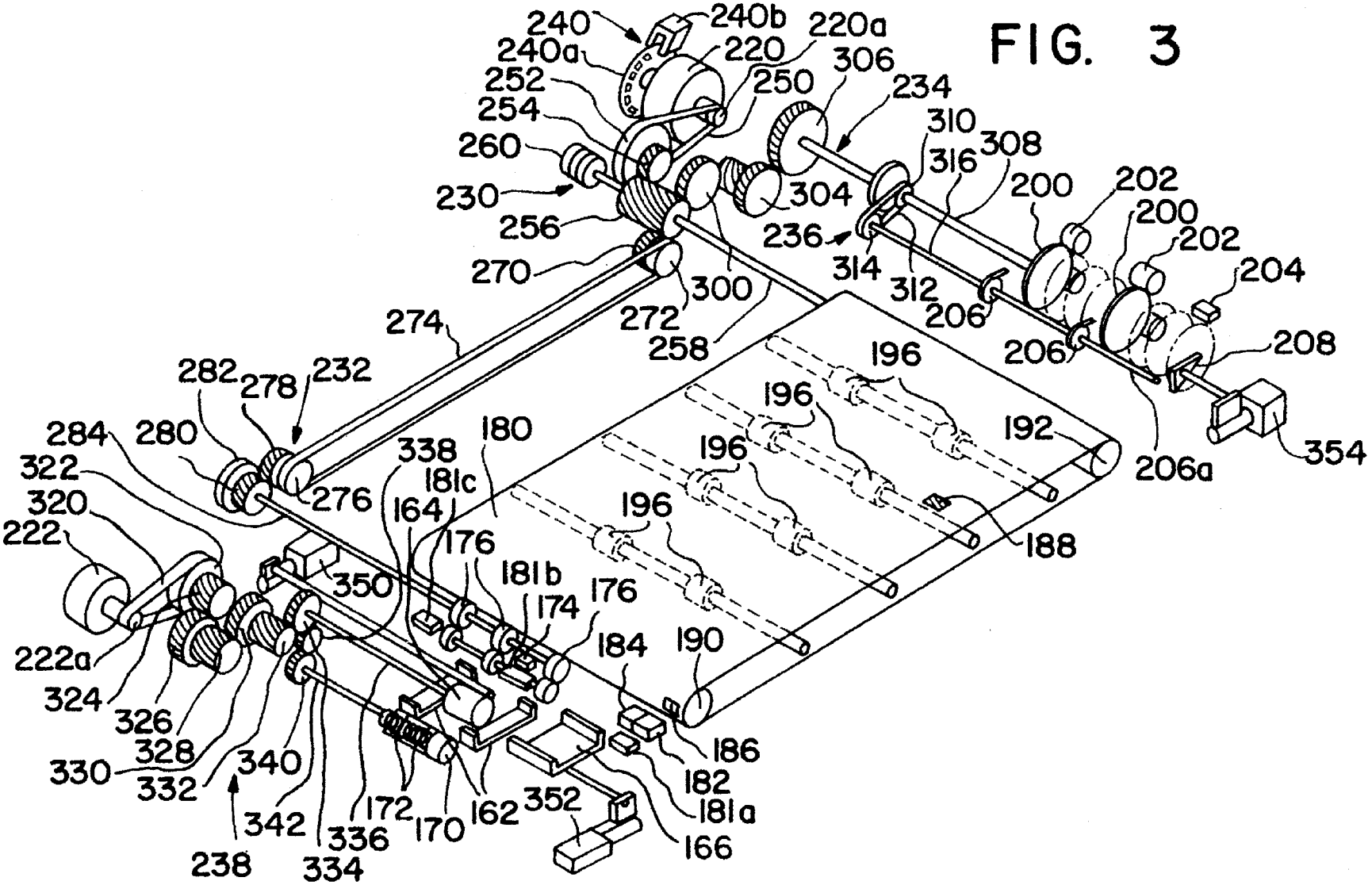
FIG. 3 is a perspective view schematically showing a transporting mechanism of the automatic-document feeder.

As shown in FIGS. 2 and 3, a shutter 162, a pick-up roller 164, a weight 166, and a document-detecting sensor 168 are arranged near one end of tray 152. Shutter 162 aligns leading edges of the sheets of originals placed on tray 152. Pick-up roller 164 picks up the sheets of original D to transport it downstream. Weight 166 presses the sheets of original D against pick-up roller 164 so as to facilitate picking up of pick-up roller 164. Document-detecting sensor 168 detects that the sheets of original D are placed on tray 152.

A document-transport roller 170 and a friction plate 172*a* are arranged along document-transport path 154 in the document-transport direction and downstream of pick-up roller 164. Document-transport roller 170 transports the sheet of original D downstream. Friction plate 172*a* is pressed against document-transport roller 170 by a spring 172*b* and the surface of friction plate 172*a* contacts with document-transport roller 170. As a result, friction plate 172*a* prevents document-transport roller 170 from transporting two or more sheets of original D at the same time.

An aligning sensor 174 is arranged just upstream of an aligning roller pair 176 and downstream of document-transport roller 170 along document transport path 154. Aligning roller pair 176 delivers the sheet of original D onto platen 12 in synchronism with a movement of a document-conveying belt 180, as described later. Aligning sensor 174 detects the sheet of original D so as to set a timing at which aligning roller pair 176 starts to transport the sheet of original D.

Image-detecting sensors 181*a*, 181*b*, and 181*c* are arranged at one end portion of tray 152 which is the closest to pick-up roller 164, and arranged at predetermined intervals in the axial direction of pick-up roller 164. Image-detecting sensors 181*a*, 181*b*, and 181*c* detect that an opposite surface of a sheet of original D has an image while a paper sheet P is transported from tray 152 to aligning roller pairs 176.

Belt-position sensors 182 and 184 are arranged downstream of aligning roller pair 176 in order to detect marks 186 and 188 which are on document-conveying belt 180, along a crossing direction which intersects in the moving direction of document-conveying belt 180. Belt-position sensors 182 and 184, in this embodiment, are located side by side each other. However, the belt-position sensors 182 and 184 may be separated from each other.

Housing 150 includes a housing cover 150*a* for removably covering the described transporting mechanism to keep an operator away from it when housing cover 150*a* is closed. An operator may remove a jammed sheet of original D in housing 150 when housing cover 150*a* is open. A sensor 150*b* is arranged near housing cover 150*a* to detect when housing cover 150*a* is open. When sensor 150*b* detects this open condition, automatic-document feeder 4 does not work to transport a sheet of original D.

Document-conveying belt 180 is stretched by belt rollers 190 and 192 on the central bottom portion of automatic-document feeder 4. Document-conveying belt 180 is inside of housing 150, transports a sheet of original D by a frictional force between the sheet of original D and document-conveying belt 180, and covers a sheet of original D on platen 12. Document-conveying belt 180 is also a white, wide, endless, and seamless belt and is driven in the forward and reverse directions by a belt-driving mechanism. A plurality of belt-retaining rollers 196 are arranged at the back side of the inner circumference of document-conveying belt 180 against platen 12 so as to facilitate transporting a sheet of original D. A sensor 198 is arranged near a hinge for connecting automatic-document feeder 4 to copying machine 2, and detects that automatic-document feeder 4 is open.

Each of marks 186 and 188 is formed on the outer circumference of document-conveying belt 180 by means of an ink, dying, or printing. A distance between marks 186 and 188 in the crossing direction which intersects in the moving direction of document-conveying belt 180 is almost equal to the distance between belt-position sensor 182 and 184 in the crossing direction. Thus, belt-position sensor 182 detects mark 186 when mark 186 is in a position at which belt-position sensor 182 faces mark 186. Belt-position sensor 184 detects mark 188 when mark 188 is in a position at which belt-position sensor 184 faces mark 188. Marks 186 and 188 are formed on document-conveying belt 180 so that both distances from mark 186 to mark 188 in the moving direction and from mark 188 to mark 186 are longer than the maximum size of originals which copying machine 2 treats.

Document-transport rollers 200, pinching rollers 202, a document-detecting sensor 204, discharging rollers 206 and spring members 207 are arranged along document-discharging path 156 downstream of document-conveying belt 180 in the document-transport direction. Document-transport rollers 200 transport the sheet of original D which is transported by document-conveying belt 180 while pinching rollers 202 press the sheet of original D against document-transporting rollers 200. Document-detecting sensor 204 detects the trailing edge of the sheet of original D to determine a discharge of the sheet of original D or to determine that the sheet of original D to be reversed has passed. Discharging rollers 206 discharge the sheet of original D onto discharge portion 154A. Spring members 207 press the sheet of original D against discharging rollers 206 so as to facilitate transporting the sheet of original D.

Also, gates 208 are arranged between document-transporting rollers 200 and discharging rollers 206. Gates 208 guide the sheet of original D to platen 12 through a reverse transport path 210 so that the opposite surface of original D faces platen 12. In this case, document-conveying belt 180 is driven in the reverse direction, as described later. This transporting mechanism is covered by a cover 212 to keep an operator away from it.

As shown in FIG. 3, automatic-document feeder 4 includes two pulse motors 220 and 222 as driving sources, and also includes five transmitting mechanisms for transmitting driving forces of pulse motors 220 and 222 to the corresponding transporting mechanism. A first transmitting mechanism 230 transmits the driving force from pulse motor 220 to belt roller 192 to rotate document-conveying belt 180. A second transmitting mechanism 232 transmits the driving force transmitted to first transmitting mechanism 230 to aligning roller pair 176. A third transmitting mechanism 234 transmits the driving force transmitted to first transmitting mechanism 230 to document-transporting rollers 200. A fourth transmitting mechanism 236 transmits the driving force transmitted to third transmitting mechanism 234 to discharging rollers 206. A fifth transmitting mechanism 238 transmits the driving force from pulse motor 222 to pick-up roller 164.

Pulse motor 220 is driven at a predetermined rotational speed by being provided with a plurality of pulses, and has an encoder 240 for outputting the rotational speed. Encoder 240 includes a disk **240*a* attached at a rotational axis of pulse motor 220 and a photointerrupter 240*b* fixed in housing 150. Photointerrupter 240*b* is arranged so that disk 240*a* is put between an emitter and a receptor, and outputs a number of pulses when disk 240*a*** rotates.

Encoder 240 couples to an ADF CPU, as described later. The ADF CPU counts the output signal provided from photointerrupter **240*b* of encoder 240 to determine a rotating amount of document-conveying belt 180**.

First transmitting mechanism 230 includes a rotor **220*a* of pulse motor 220, a belt 250, a clutch 252 for intermittently transmitting the driving force and having a pulley thereabout, a gear 254 arranged in a concentric configuration with respect to clutch 252, a gear 256 fixed in a concentric configuration with respect to a rotational shaft 258 of belt roller 192, and a brake 260. Belt 250 is stretched by rotor 220*a* and the pulley attached to clutch 252. Gear 254 meshes gear 256. In first transmitting mechanism 230, the driving force is transmitted from pulse motor 220 to belt roller 192 through rotor 220*a*, belt 250, clutch 252, gear 254, gear 256 and rotational shaft 258. Brake 260 is constructed in a concentric configuration with respect to rotational shaft 258 so as to prevent rotational shaft 258** from racing.

Second transmitting mechanism 232 includes a gear 270, a pulley 272 fixed in a concentric configuration with respect to gear 270, a belt 274, a pulley 276, a gear 278, a gear 280, and a clutch 282 for intermittently transmitting the driving force to a rotational shaft 284 of aligning roller pairs 176. Gear 270 meshes gear 256 in first transmitting mechanism 230. Belt 274 is stretched by pulleys 272 and 276. Gear 278 meshes gear 280. Thus, the driving force is intermittently transmitted from gear 256 to aligning roller pairs 176 through gear 270, pulley 272, belt 274, pulley 276, gear 278, gear 280, and rotational shaft 284.

Third transmitting mechanism 234 includes a gear 300, a gear 302, a gear 304 fixed in a concentric configuration with respect to gear 302, and a gear 306 fixed in a concentric configuration with respect to a rotational shaft 308 of document-transporting rollers 200. Gear 300 meshes gear 256 in first transmitting mechanism 230. Gear 302 meshes gear 300. Gear 306 meshes gear 304. Therefore, the driving force is transmitted from gear 256 to document-transporting rollers 200 through gear 300, gear 302, gear 304, gear 306, and rotational shaft 308.

Fourth transmitting mechanism 236 includes a pulley 310 fixed in a concentric configuration with respect to rotational shaft 308, a belt 312, and a pulley 314 fixed in a concentric configuration with respect to a rotational shaft 316 of discharging rollers 206. Belt 312 is stretched by pulleys 310 and 314. Thus, the driving force is transmitted from rotational shaft 308 to discharging rollers 206 through pulley 310, belt 312, pulley 314, and rotational shaft 316.

Pulse motor 222 is driven at a predetermined rotational speed by being provided with a plurality of pulses.

Fifth transmitting mechanism 238 includes a rotor **222*a* of pulse motor 222, a belt 320, a clutch 322 for intermittently transmitting the driving force and having a pulley therearound, a gear 324 arranged in a concentric configuration with respect to pulley 322, a gear 326, a gear 328 fixed in a concentric configuration with respect to gear 326, a gear 330, a gear 332 fixed in a concentric configuration with respect to gear 330, a gear 334 fixed in a concentric configuration with respect to a rotating shaft 336 of pick-up roller 164, a gear 338, and a gear 340 fixed in a concentric configuration with respect to a rotating shaft 342 of document-transport roller 170. Belt 320 is stretched by rotor 222***a* and pulley 322. Gear 324 meshes gear 326. Gear 328 meshes gear 330. Gear 332 meshes 334. Gear 334 meshes gear 338 meshing gear 340. Therefore, the driving force is transmitted from pulse motor 222 to pick-up roller 164 through rotor 222*a*, belt 320, pulley 322, gears 324, 326, 328, 330, 332, 334, and rotating shaft 336, and is also transmitted from gear 334 to document-transport roller 170 through gear 338, gear 340, and rotating shaft 342.

Furthermore, automatic-document feeder 4 includes a shutter solenoid 350, a weight solenoid 352, and a gate solenoid 354. Shutter solenoid 350 drives shutter 162 so that document-transport path 154 is opened when shutter solenoid 350 is energized. Weight solenoid 352 drives weight 166 so that weight 166 presses sheets of original D against pick-up roller 164 when weight solenoid 352 is energized. Gate solenoid 354 drives gates 208 so that gates 208 guide a sheet of original D to reverse transport path 210 when gate solenoid 354 is energized. These solenoids 350, 352, and 354 are energized by a mechanical controller described later.

When an opposite surface of a sheet of original D transported by automatic-document feeder 4 has an image, document-transporting belt 180 is rotated by pulse motor 220 and first transmitting mechanism 230 until belt-position sensor 182 detects mark 186. Then, aligning roller pairs 176 transport the sheet of original D so that the leading edge of the sheet of original D corresponds to mark 186. After that, the opposite surface comes to be in contact with a first specific area of document-transporting belt 180 which begins from mark 186, and is positioned on platen 12. As described above, image-detecting sensors 181*a*, 181*b*, and 181*c* detect that the opposite surface has an image. Furthermore, when an operator sets copying machine 2 into a predetermined mode by using a control panel 400 as shown in FIG. 4, a control system determines that the opposite surface of a sheet of original D has an image.

When an opposite surface does not have an image and a copy image formed on paper sheet P corresponds to not only an original image of a front surface of original D facing platen 12 but also an outside area of the original image which is covered by document-transporting belt 180 because of a size of a sheet of original D, a size of paper sheet P, and a magnification ratio, document-transporting belt 180 is rotated until belt-position sensor 184 detects mark 188. After that, the opposite surface comes to be in contact with a second specific area of document-transporting belt 180 which begins from mark 188, and is positioned on platen 12. The second specific area is not made dirty, because there is no image, for example, a toner image, on the opposite surface. Thus, even if the copy image includes the outside area of the original image, an unnecessary image is not formed on a paper sheet P. What an operator inputs by using control panel 400 makes copying machine 2 determine that a copy image includes an outside area of original D.

Figure 4:
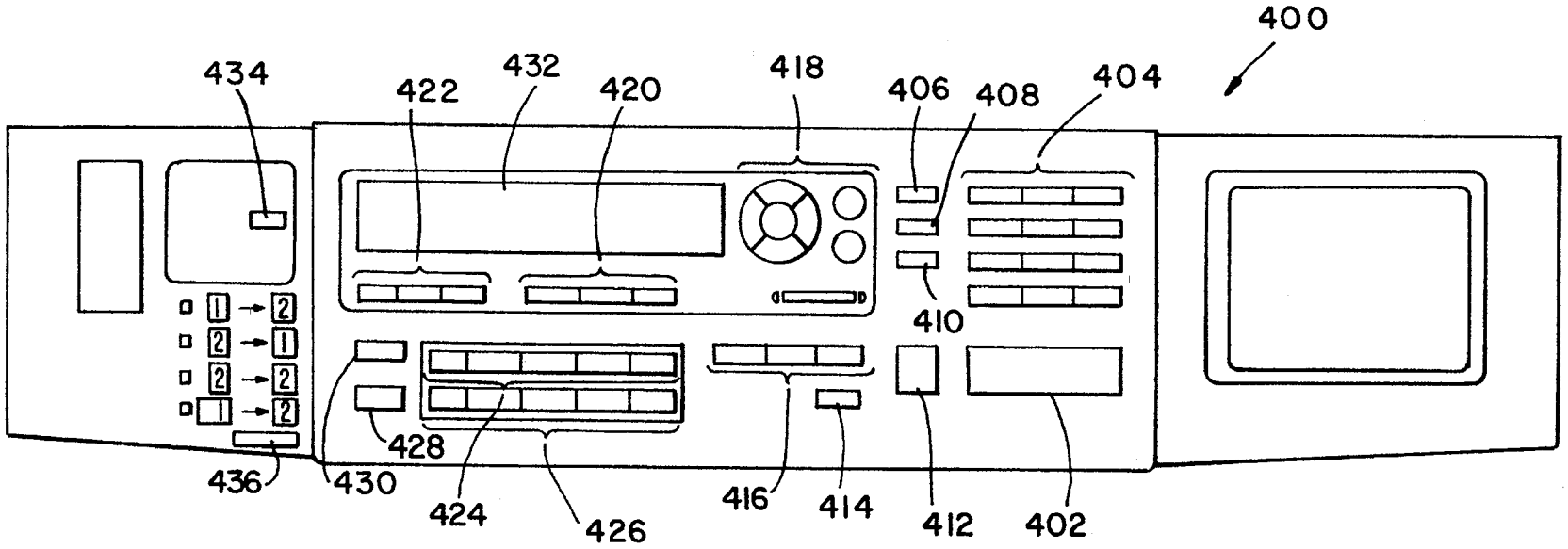
FIG. 4 is a plan view of the control panel of the image-forming apparatus.

Control panel 400 is mounted on housing 6 and is shown in detail in FIG. 4. Control panel 400 carries thereon a copy key 402 for starting the copying operation, keys 404 for setting the number of copies to be made and the like, a function clear key 406 for setting the standard status, an energy saver key 408 for going into the energy-saving mode and turning all its display lamps off, an interrupt key 410 for making a copy of a different original during a multicopy run, and a clear/stop key 412 for clearing the copy quantity entered or stopping a multicopy run. Control panel 400 has a photo key 414 on the left side of clear/stop key 412. When photo key 414 is depressed once, copying machine 2 is set in the photo mode from the normal mode.

Control panel 400 is further provided with a density setting section 416 for setting the copy density, an editing key 418 for setting the trimming mode or masking mode, operation guide keys 420 for asking the appropriate operation procedure and answering the questions from copying machine 2, zoom keys 422 for adjustably setting the magnification ratio, for example, the enlargement or reduction ratio, an original size key 424 for setting a size of a sheet of an original D, a copy size key 426 for selecting the paper sheet size, an automatic paper selection key 428 for automatically detecting the size of the original set on platen 12 and selecting a paper sheet of the same size as the original, an automatic magnification selection key 430 for automatically detecting the size of a sheet of original D set on platen 12 and calculating the correct reproduction or enlargement ratio, and a display section 432 for indicating the operating conditions of the individual parts. Additionally arranged on control panel 400 are a cassette selection key 434 for alternatively selecting upper paper cassette 50 and lower paper cassette 52, and an auto-duplex key 436. When an operator depresses auto-duplex key 436 once, copying machine 2 is set in a single-side to duplex copying mode for making duplex copies from two-sided originals. When an operator depresses auto-duplex key 436 twice, copying machine 2 is set in a two-sides to duplex copying mode for making duplex copies from two-sided originals. When an operator depresses auto-duplex key 436 three times, copying machine 2 is set in a two-sides to single copying mode for making single-sided copies from single-sided originals. When an operator depresses auto-duplex key 436 four times, copying machine 2 is set in a book-type to duplex copying mode for making duplex copies from book-type originals. When an operator depresses auto-duplex key 436 five times, copying machine 2 concerning these modes is initialized.

If the two-sides to duplex copying mode or the two-sides to single copying mode is set by an operator using auto-duplex key 436, copying machine 2 determines that an opposite surface of a sheet of original D has an original. Thus, automatic-document feeder 4 transports the sheet of original D so that the leading edge of the sheet of original D corresponds to mark 186, and so that the opposite surface is in contact with the first specific area.

Figure 5B:
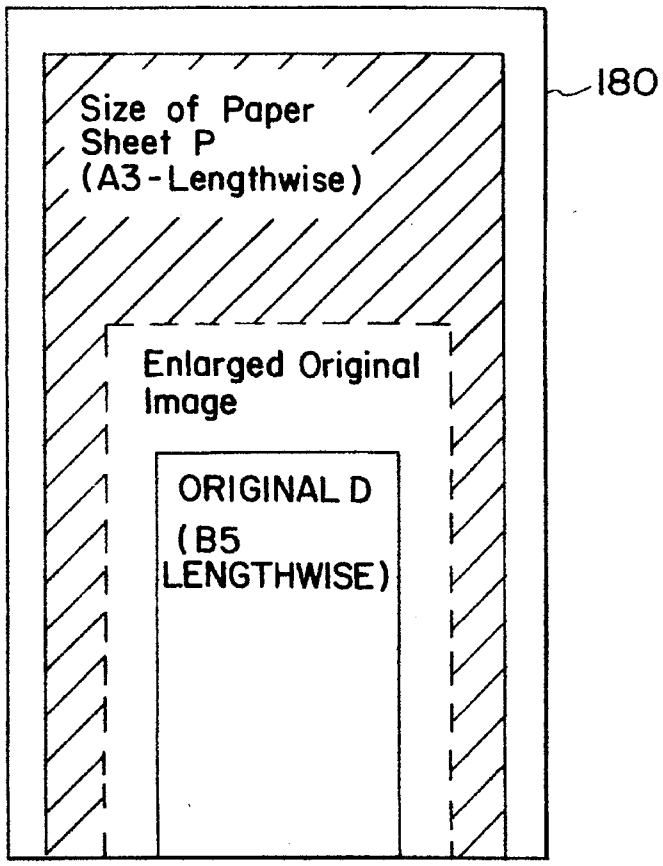
FIGS. 5(*a*) and 5(*b*) are diagrams showing conditions in which a copy image of a document-transporting belt is formed.
Figure 5A:
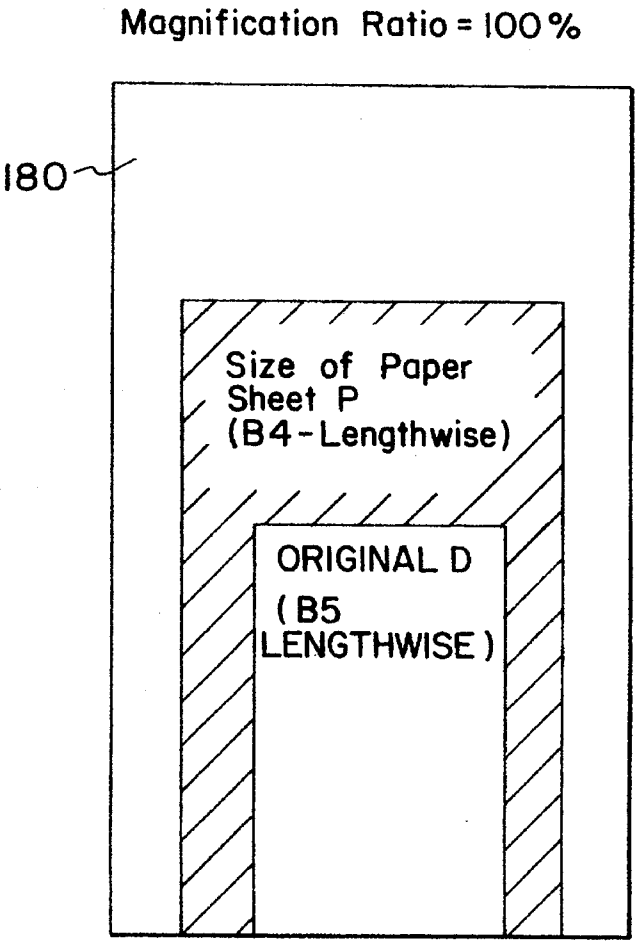

In the meantime, when a copying condition is set by an operator using zoom keys 422, original size key 424, and copy size key 426 in control panel 400 so that, for example the magnification is "100%" the original size is "B5-LENGTHWISE" and the copy size is "B4-LENGTHWISE" as shown in FIG. 5(*a*), the shadowed portion corresponds to an outside area of the original image covered by document-transporting belt 180.

When a copying condition is set by an operator so that, for example, the magnification is "120%" the original size is "B5-LENGTHWISE" and the copy size is "A3-LENGTHWISE" as shown in FIG. 5(*b*), the shadowed portion corresponds to an outside area of the original image covered by document-transporting belt 180.

In these cases, if an opposite surface of a sheet of original D does not have an image, automatic-document feeder 4 transports the sheet of original D so that the leading edge of the sheet of original D corresponds to mark 188, and so that the opposite surface is in contact with the second specific area.

A control system of copying machine 2 and automatic-document feeder 4 is described in detail below.

Figure 6A:
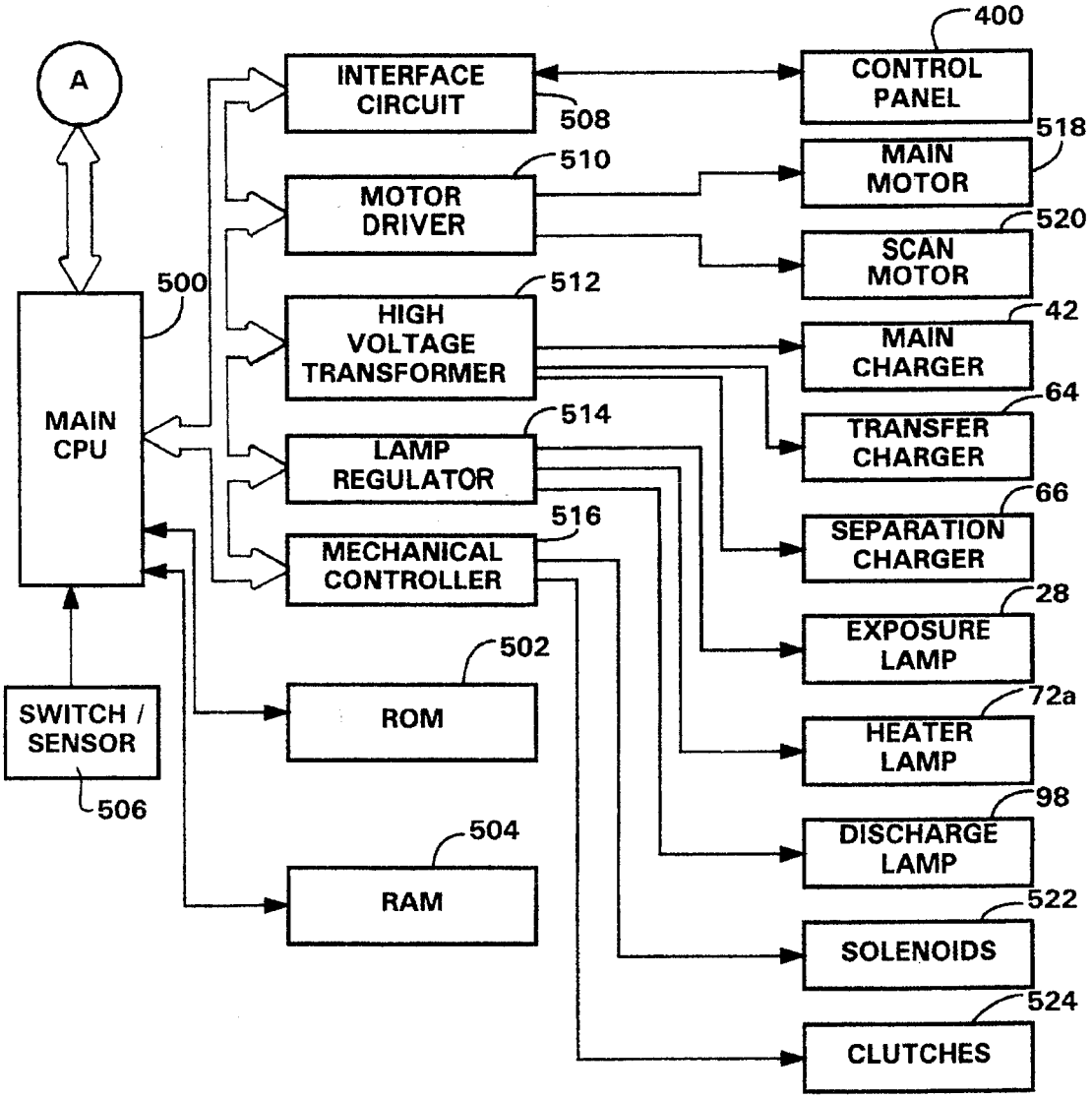
FIGS. 6(*a*) and 6(*b*) are diagrams showing the control system of the image-forming apparatus and the automatic-document feeder.
Figure 6B:
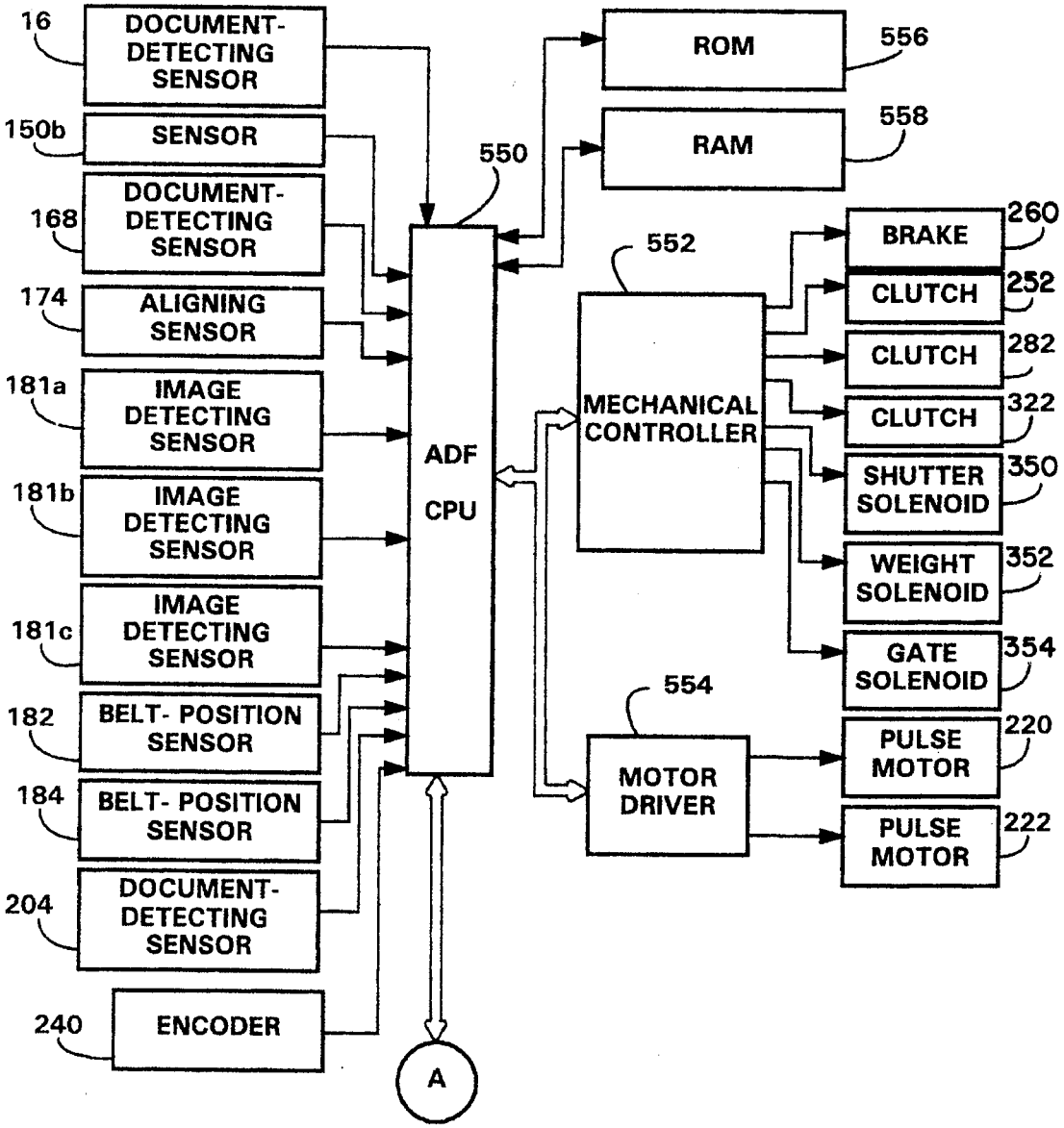
Figure 7A:
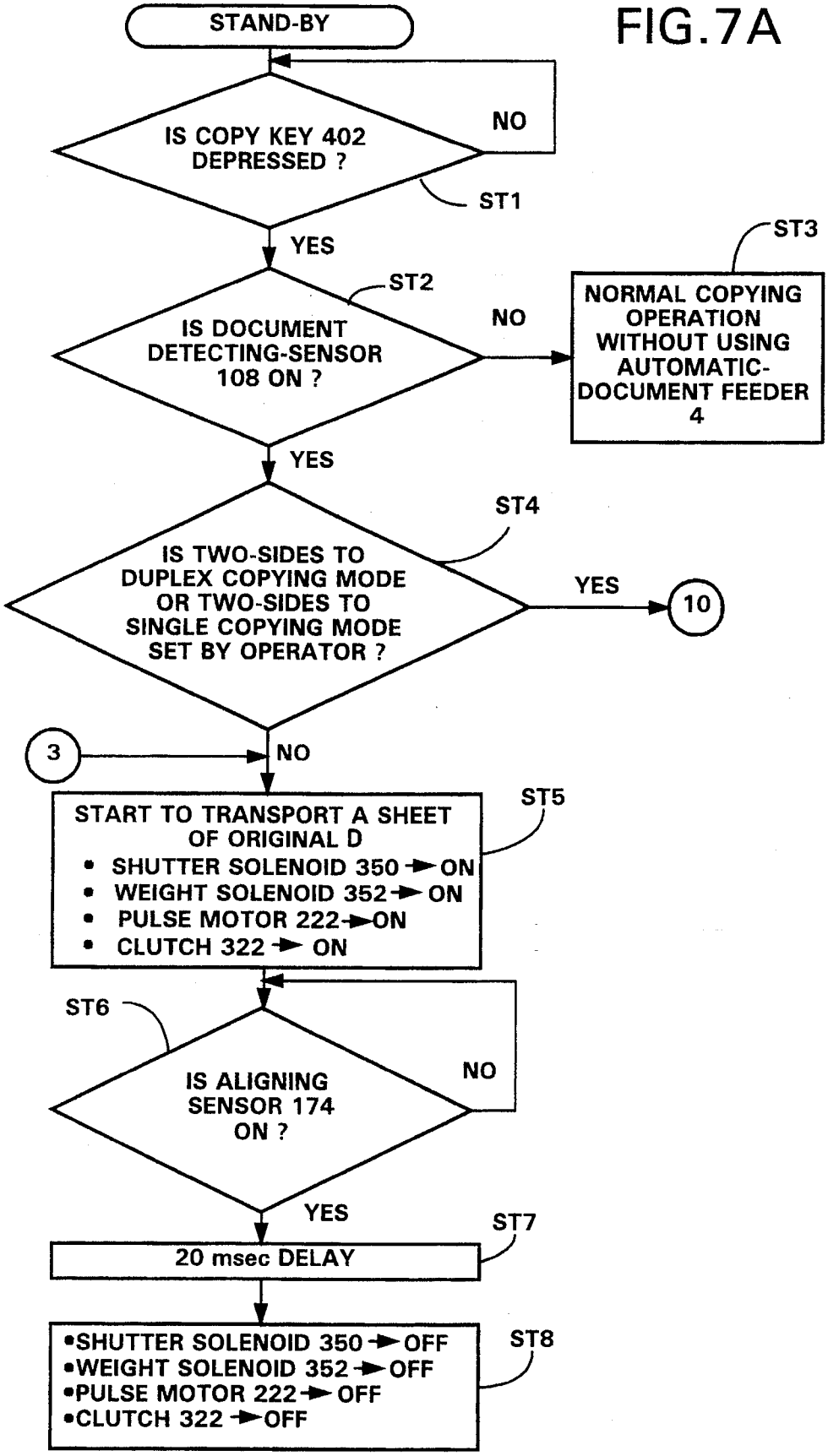
FIGS. 7(*a*) to 7(*i*) are flow charts for illustrating the operation of the control system shown in FIGS. 6(*a*) and 6(*b*)
Figure 7B:
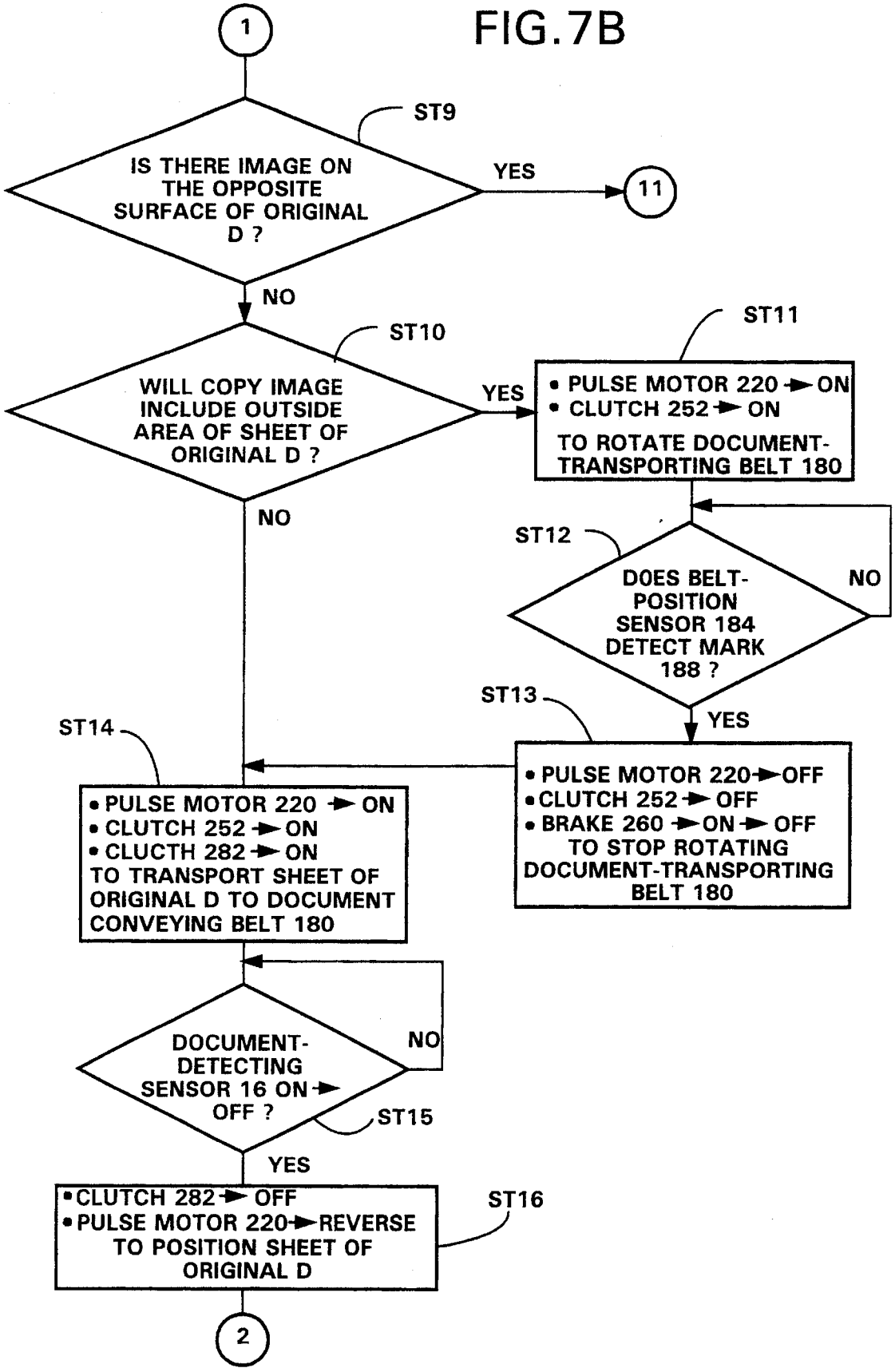
Figure 7C:
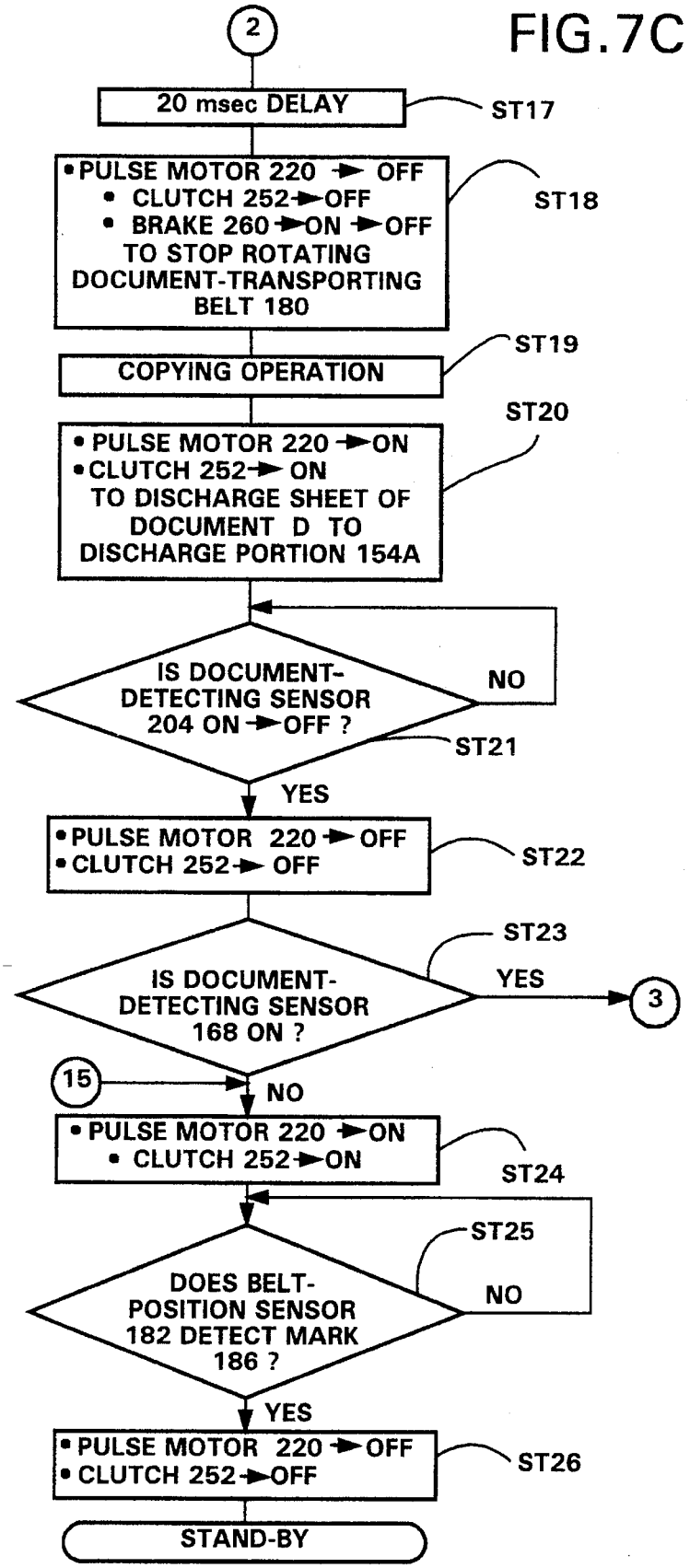
Figure 7D:
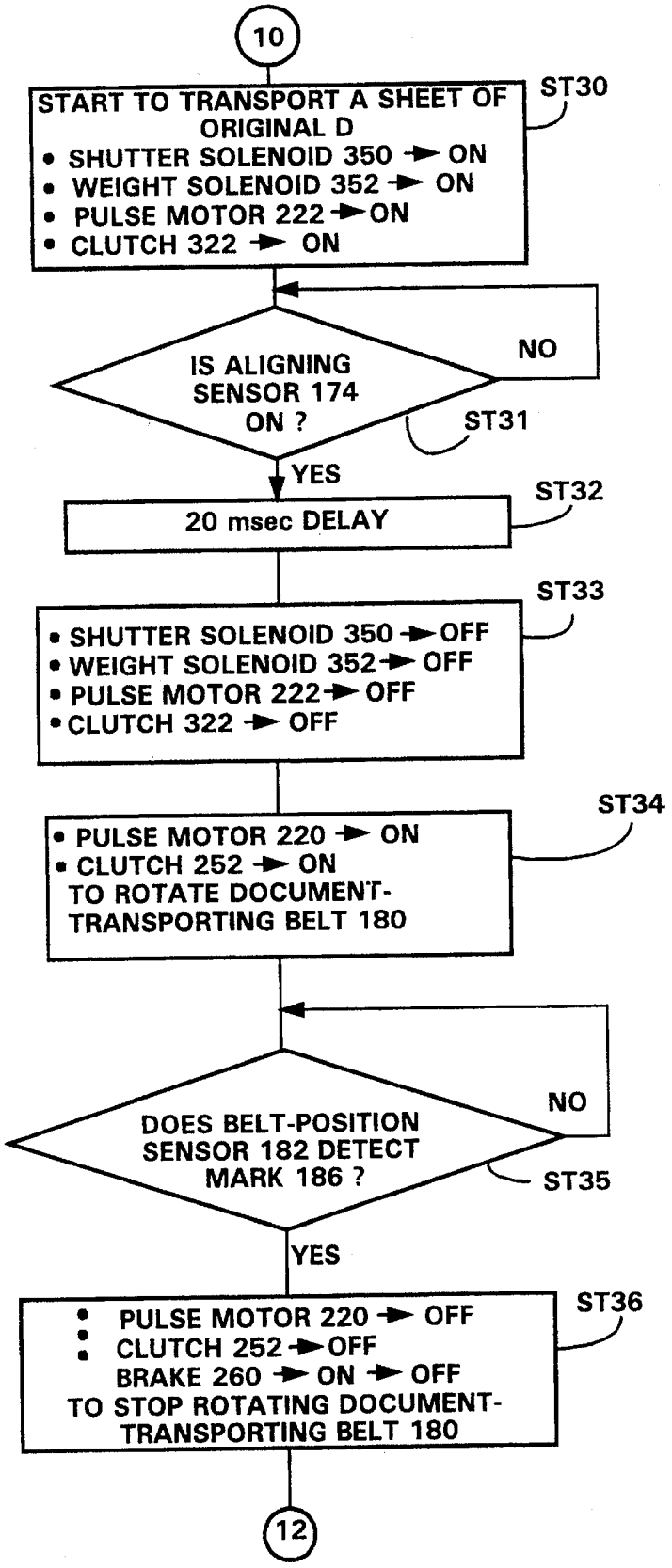
Figure 7E:
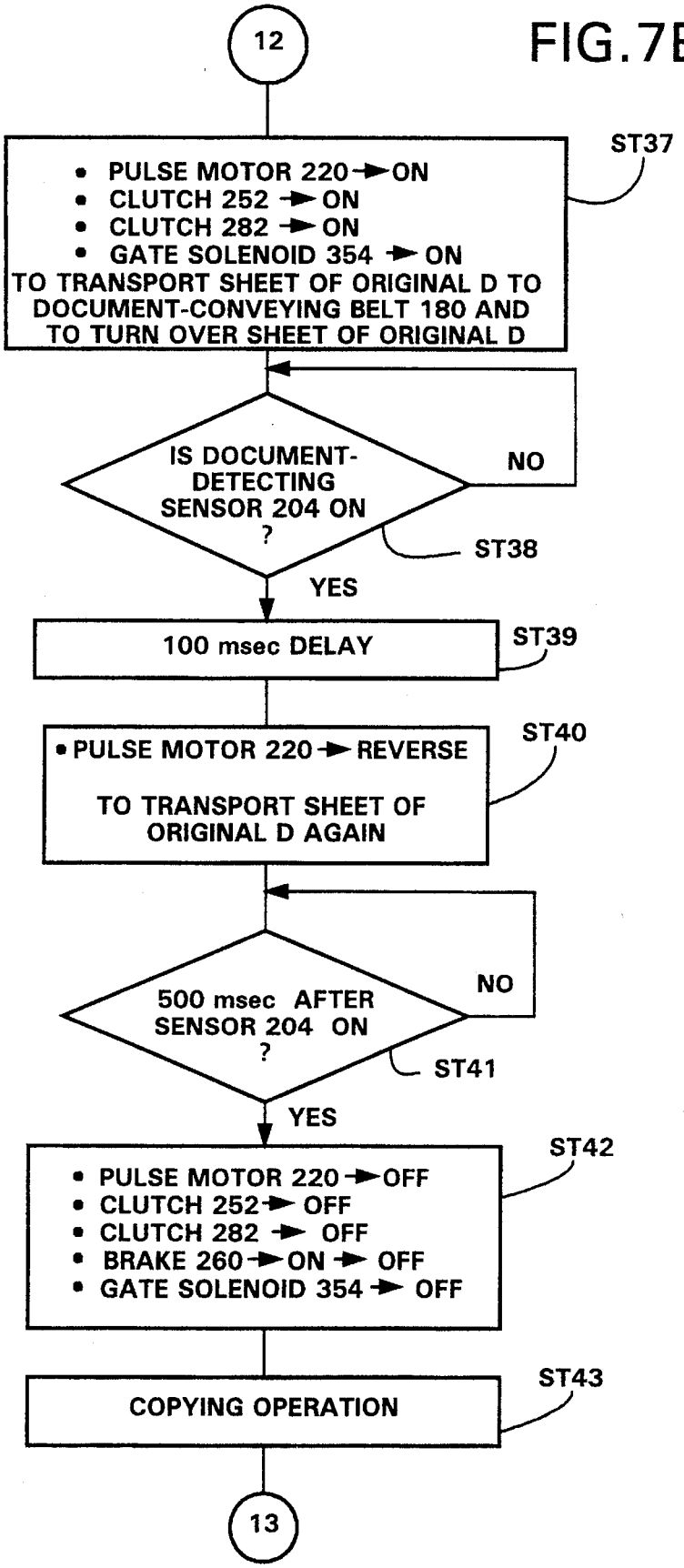
Figure 7F:
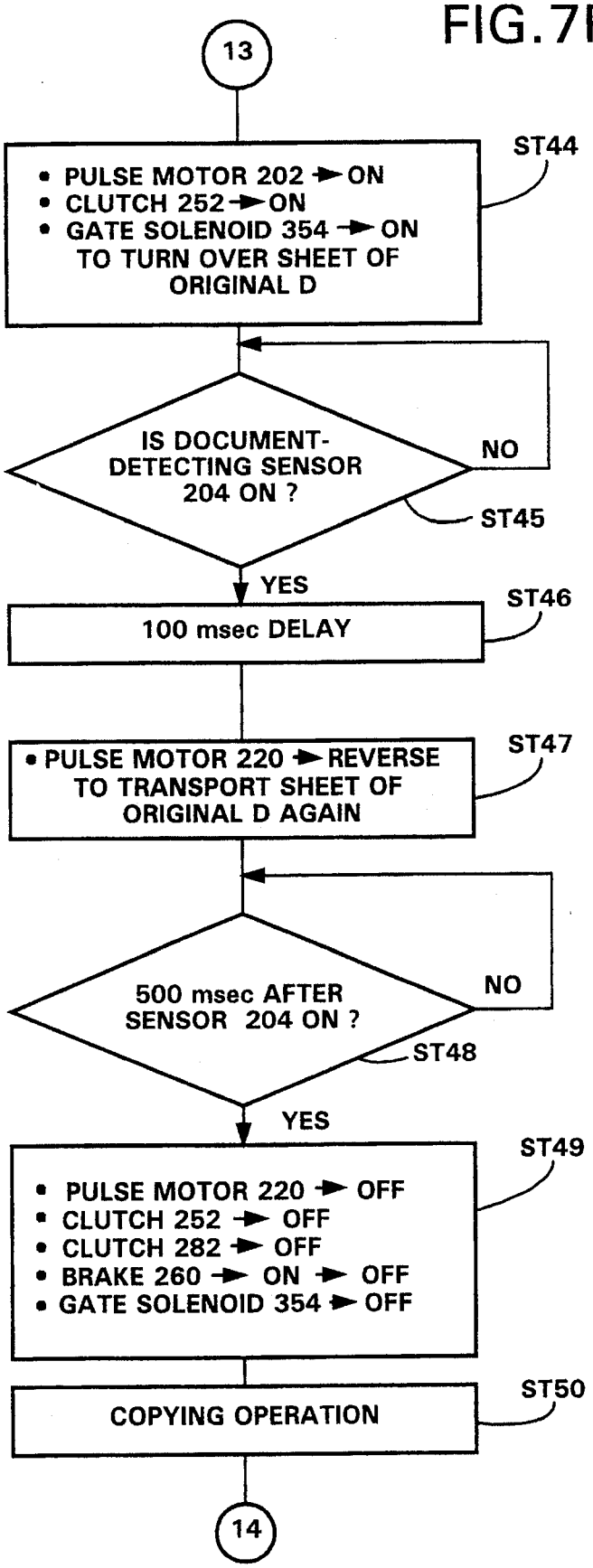
Figure 7G:
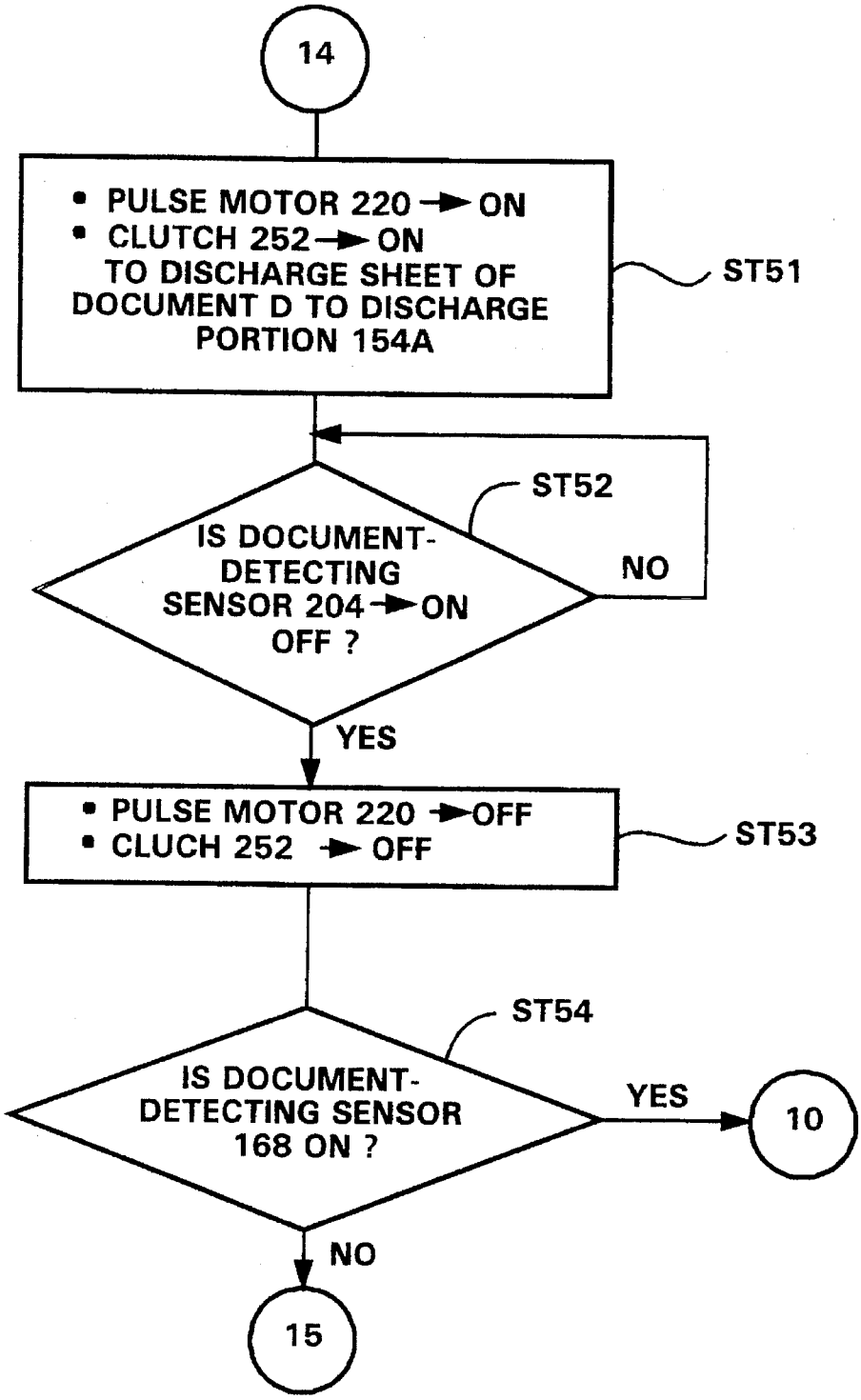
Figure 7H:
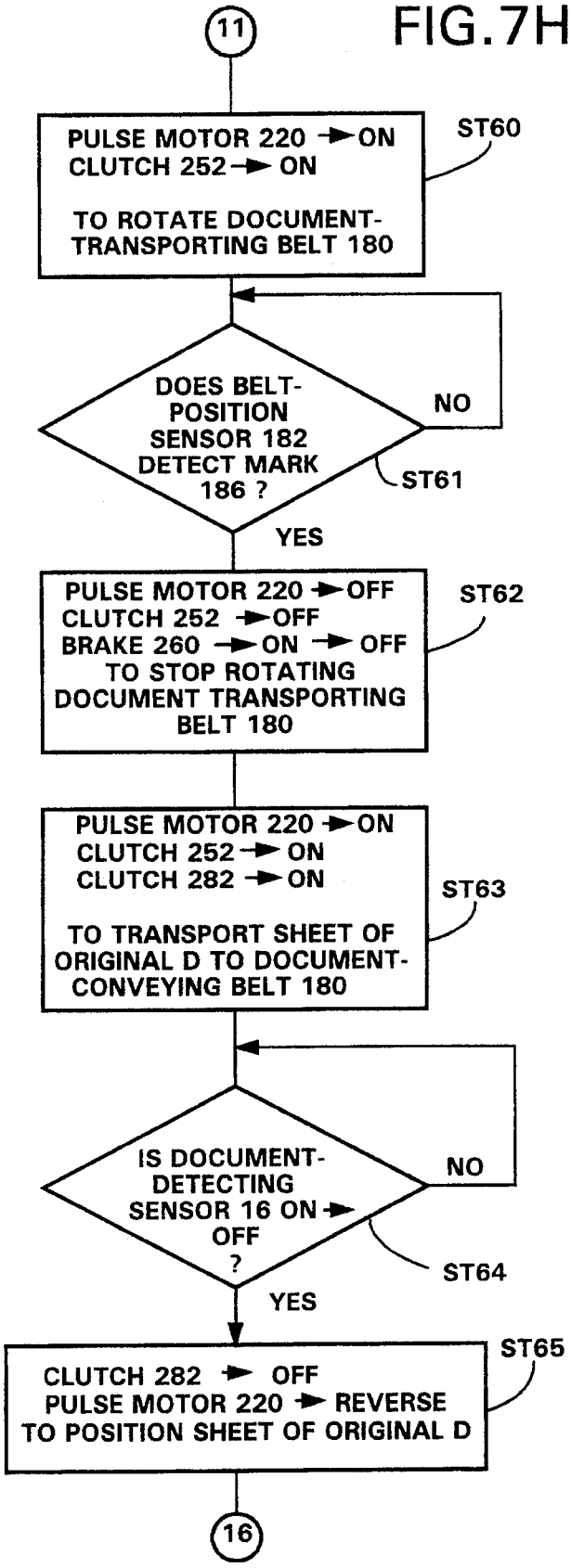
Figure 7I:
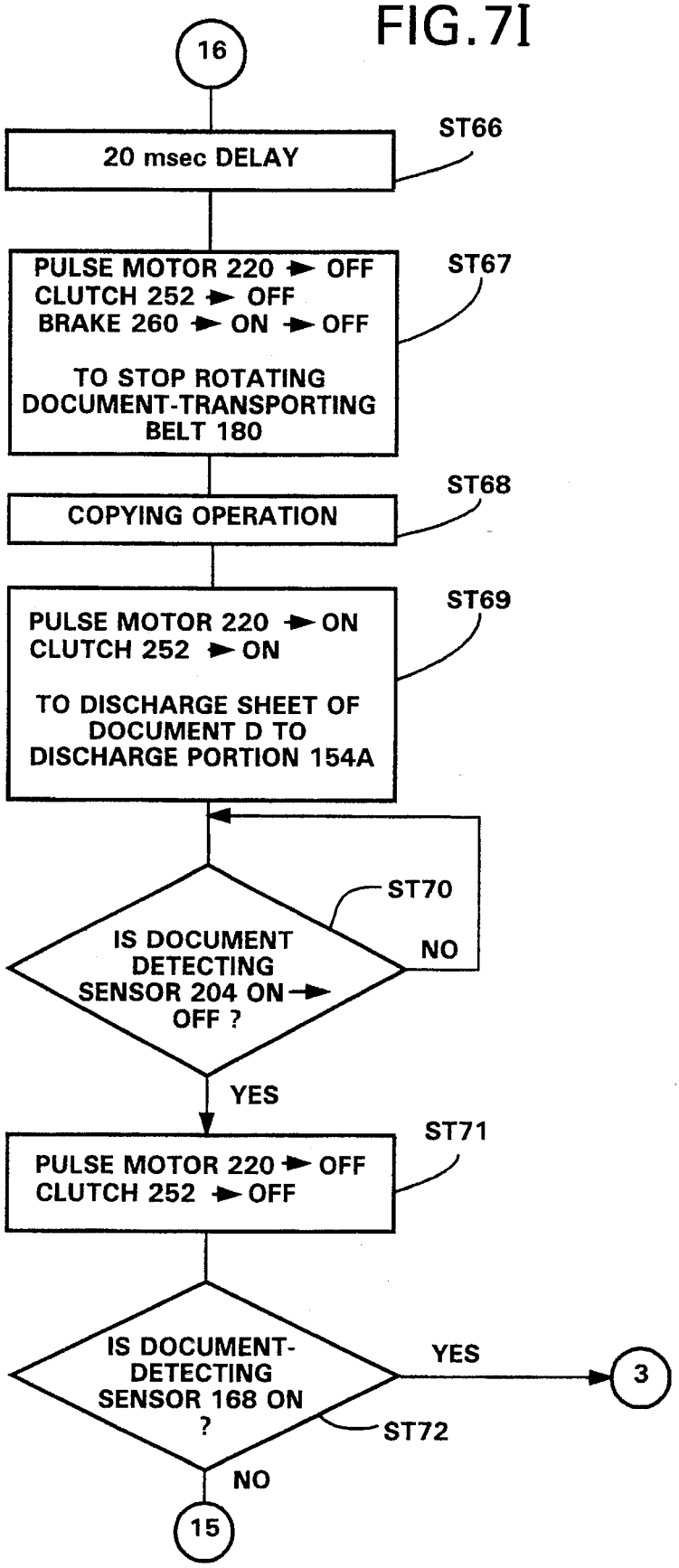
Figure 8A:
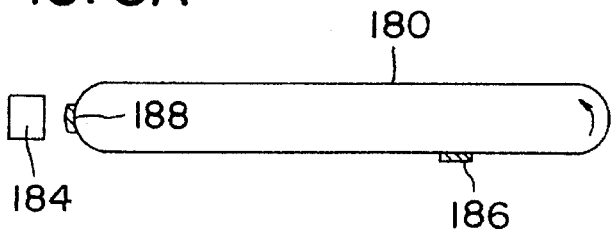
FIGS. 8(*a*) to 8(*d*) are sectional views of the automatic-document feeder for use in better understanding the flow charts of FIGS. 7(*a*) to 7(*i*)
Figure 8B:
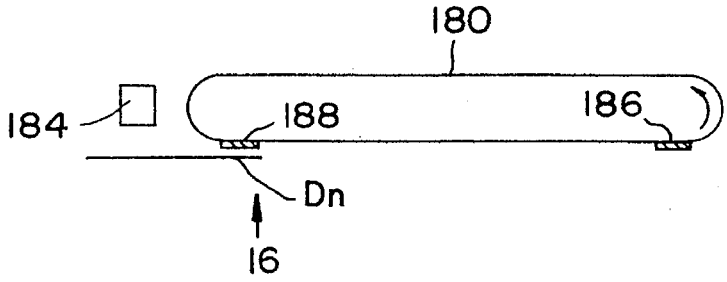
Figure 8C:
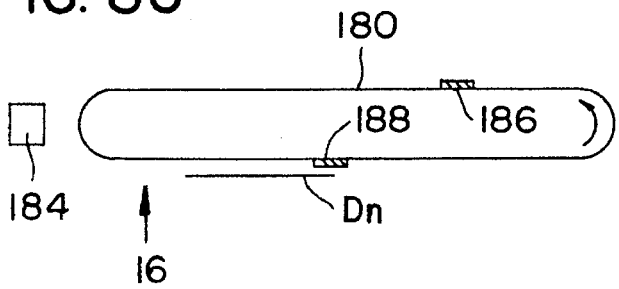
Figure 8D:
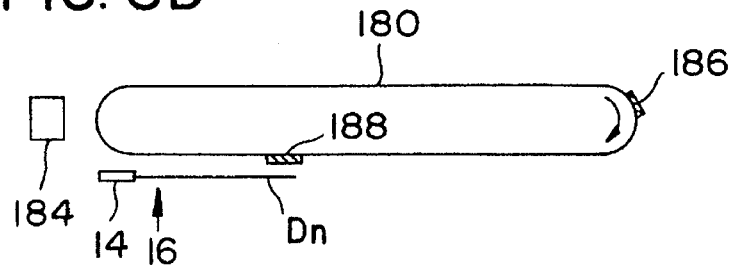
Figure 9A:
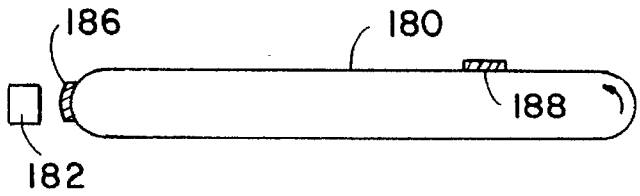
FIGS. 9(*a*) to 9(*d*) are sectional views of the automatic-document feeder for use in better understanding the flow charts of FIGS. 7(*a*) to 7(*i*)
Figure 9B:
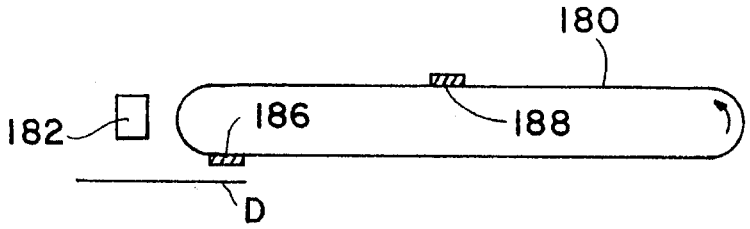
Figure 9C:
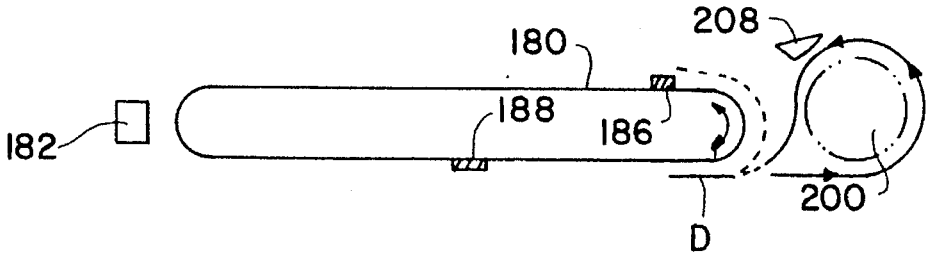
Figure 9D:
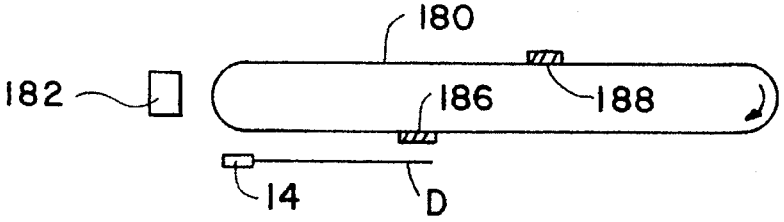

As shown in FIG. 6(*a*), the control system has a main CPU 500 which controls the control system. A ROM 502 stores a control program. A RAM 504 is used as a work buffer of main CPU 500. Main CPU 500 couples to an input device 506 including switches and sensors. The sensors include sensor 198. Furthermore, main CPU 500 couples to an interface circuit 508, a motor driver 510, a high-voltage transformer 512, a lamp regulator 514, and a mechanical controller 516. Interface circuit 508 exchanges signals between main CPU 500 and control panel 400. Motor driver 510 energizes a main motor 518 for driving photosensitive drum 40, developing roller 44*a*, the rollers which transport paper sheet P, heat roller 72, and so on, and energizes a scan motor 520 for driving first carriage 20 and second carriage 22. High-voltage transformer 512 energizes main charger 42, transfer charger 64, and separation charger 66. Lamp regulator 514 causes exposure lamp 28, heater lamp 72*a*, and discharge lamp 98 to turn on. Mechanical controller 516 energizes solenoids 522 and clutches 524 arranged in copying machine 2.

Also, main CPU 500 couples to an ADF (Automatic Document Feeder) CPU 550 as shown in FIG. 6(*b*).

ADF CPU 550 couples to document-detecting sensor 16, sensor 150*b*, document-detecting sensor 168, aligning sensor 174, image-detecting sensors 181*a*, 181*b*, and 181*c*, belt-position sensors 182 and 184, document-detecting sensor 204, and encoder 240 to receive output signals which they output. Furthermore, ADF CPU 550 couples to a mechanical controller 552 and a motor driver 554. Mechanical controller 552 energizes brake 260, clutches 252, 282, and 322, shutter solenoid 350, weight solenoid 352, and gate solenoid 354. Motor driver 554 energizes pulse motors 220 and 222. A ROM 556 stores a control program. A RAM 558 is used as a work buffer of ADF CPU 550.

The operation of copying machine 2 with automatic-document feeder 4 will be described in detail in reference to FIGS. 7(*a*) to 7(*i*), 8(*a*) to 8(*d*), and 9(*a*) to 9(*d*).

When a power supply (not shown) of copying machine 2 is turned on, heater lamp 72*a* is turned on so that each surface temperature of heat roller 72 and pressure roller 74 comes to be hot enough to fix a transferred image onto paper sheet P. At the same time, main charger 42 charges the surface of photosensitive drum 40 and discharge lamp 98 discharges it, for a predetermined time period so as to initialize the surface potential of photosensitive drum 40. Then, copying machine 2 becomes to be in a stand-by condition in which copying machine 2 may copy.

When copying machine 2 is in the stand-by condition, if copy key 402 is depressed, main CPU 500 checks whether document-detecting sensor 168 arranged in automatic-document feeder 4 is turned on through ADF CPU 550 (steps ST1 and ST2). If main CPU 500 determines that document-detecting sensor 168 is not turned on, copying machine 2 performs a normal copying operation without using automatic-document feeder 4 (step ST3). If main CPU 500 determines that document-detecting sensor 168 is turned on, then main CPU 500 checks whether either the two-sides to duplex copying mode or the two sides to single copying mode is set by the operator using control panel 400 (step ST4). If main CPU 500 determines that neither the two-sides to duplex copying mode nor the two-sides to single copying mode is set, then main CPU 500 causes automatic-document feeder 4 to start to transport a sheet of original D (step ST5). In this time, main CPU 500 causes motor driver 510 to energize main motor 518 to rotate, causes high-voltage transformer 512 to energize main charger 42 to charge photosensitive drum 40, and causes lamp regulator 514 to energize exposure lamp 98 to discharge the surface potential of photosensitive drum 40. This operation is a preparation to make a copy. For transporting a sheet of original D, ADF CPU 550 causes mechanical controller 552 and motor driver 554 to energize shutter solenoid 350, weight solenoid 352, pulse motor 222, and clutch 322. ADF CPU 550 receives the output signals output by image-detecting sensors 181*a*, 181*b*, and 181*c* during transporting of the sheet of original D.

In the meantime, when neither the two-sides to duplex copying mode nor the two-sides to single copying mode is set, a set of originals D is stacked on tray 152 so that the original surface of original D to be copied is up, the top sheet D1 has the first page, and the bottom sheet Dn has the last page. Even if the original surface of original D is only one side, the other surface may have an image in the case that the sheet of original D is a recycled sheet. Therefore, main CPU 500 checks the output signals output by image-detecting sensors 181*a*, 181*b*, and 181*c* to determine that there is an image on an opposite surface to an original surface of original D.

After step ST5, ADF CPU 550 causes mechanical controller 552 and motor driver 554 to stop energizing shutter solenoid 350, weight solenoid 352, pulse motor 222, and clutch 322 when 20 msec has elapsed after aligning sensor 174 detects the sheet Dn of original D (steps ST6 to ST8). The time period 20 msec is set to align the leading edge of a sheet of original D by putting the leading edge to aligning roller pairs 176.

After step ST8, main CPU 500 checks whether there is an image on the opposite surface of the sheet Dn of original D on the basis of the output signals which ADF CPU 550 received (step ST9). If main CPU 500 determines that there is not an image on the opposite surface, main CPU 500 checks whether the copy image will include an outside area of the sheet Dn of original D on the basis of the copying condition set by an operator using control panel 400 (step ST10). If main CPU 500 determines that the copy image will include the outside area, then main CPU 500 causes ADF CPU 550 to rotate document-transporting belt 180 (step ST11). ADF CPU 550 causes mechanical controller 552 and motor driver 554 to energize pulse motor 220 and clutch 252 until belt-position sensor 184 detects mark 188 (see FIG. 8(*a*)), then ADF CPU 550 causes mechanical controller 552 and motor driver 554 to stop energizing pulse motor 220 and clutch 252 (steps ST12 and ST13). After that, ADF CPU 550 causes mechanical controller 552 and motor driver 554 to energize pulse motor 220, clutch 252, and clutch 282 so that the leading edge of the sheet of original D corresponds to mark 188, until the output signal of document-detecting sensor 16 changes from "ON" to "OFF" (see FIGS. 8(*b*) and 8(*c*)), (steps ST14 and ST15). In this time, the second specific area of document-transporting belt 180 is in contact with the opposite surface of the sheet Dn. The "ON" signal of document-detecting sensor 16 represents detecting the sheet of original D, and the "OFF" signal of document-detecting sensor 16 represents non-detecting the sheet of original D. If main CPU 500 determines that the copy image will not include the outside area, then main CPU 500 skips steps ST11 to ST13.

If ADF CPU 550 determines at step ST15 that the output signal of document-detecting sensor 16 changes from "ON" to "OFF" then ADF CPU 550 causes mechanical controller 552 to stop energizing clutch 282, and causes motor driver 554 to energize pulse motor 220 to rotate in a reverse direction so as to position the sheet Dn of original D onto platen 12 (see FIG. 8(*d*)) (step ST16). After a delay of 20 msec from pulse motor 220 on in the reverse direction, ADF CPU 550 causes motor driver 554 to stop energizing pulse motor 220, and causes mechanical controller 552 to stop energizing clutch 252 and to energize brake 260 for a predetermined time period, so as to stop rotating document-transporting belt 180 (steps ST17 and ST18). At the same time, ADF CPU 550 sends main CPU 500 a first status signal which represents a completion of positioning the sheet Dn of original D.

When main CPU 500 receives the first status signal from ADF CPU 550, main CPU 500 causes motor driver 510, high-voltage transformer 512, lamp regulator 514, and mechanical controller 516 to energize the image-forming elements to which each of them couples, so as to perform the copying operation (step ST19). After the copying operation, main CPU 500 sends ADF CPU 550 a second status signal which represents the completion of the copying operation.

When ADF CPU 550 receives the second status from main CPU 500, ADF CPU 550 causes mechanical controller 552 to energize clutch 252, and causes motor driver 554 to energize pulse motor 220, so as to transport the sheet by a frictional force of document-transporting belt 180 and discharge the sheet Dn of document D to discharge portion 154A (step ST20). After that, ADF CPU 550 causes mechanical controller 552 and motor driver 554 to stop energizing clutch 252 and pulse motor 220 when the output signal of document-detecting sensor 204 goes from "ON" to "OFF" (steps ST21 and ST22). The "ON" signal of document-detecting sensor 204 represents detecting the sheet of original D, and the "OFF" signal of document-detecting sensor 204 represents non-detecting the sheet of original D.

After step ST22, ADF CPU 550 checks whether document-detecting sensor 168 is turned on (step ST23). If ADF CPU 550 determines that document-detecting sensor 168 is turned on, then the flow chart returns to step ST5.

If ADF CPU 550 determined that document-detecting sensor 168 is not turned on, then ADF CPU 550 causes mechanical controller 552 and motor driver 554 to energize clutch 252 and pulse motor 220 until belt-position sensor 182 detects mark 186 (steps ST24 to ST26). After that, copying machine 2 comes to be in the stand-by condition. Thus, when copying machine 2 is in the stand-by condition, the first specific area, namely the dirty area, does not face to platen 12. As a result, when an operator makes a copy without using automatic-document feeder 4, the copy image does not get dirty even if the copy image includes an outside area of an original image.

If main CPU 500 determines at step ST4 that either the two-sides to duplex copying mode or the two-sides to single copying mode is set, then main CPU 500 causes automatic-document feeder 4 to start to transport a sheet of original D as well as step ST5 (step ST30). In this time, main CPU 500 performs the preparation to make a copy. For transporting a sheet of original D, ADF CPU 550 causes mechanical controller 552 and motor driver 554 to energize shutter solenoid 350, weight solenoid 352, pulse motor 222, and clutch 322 until 20 msec has elapsed after aligning sensor 174 detects the sheet of original D like steps ST6 to ST8 (steps ST31 to ST33).

Next, main CPU 500 causes ADF CPU 550 to rotate document-transporting belt 180 (step ST34). ADF CPU 550 causes mechanical controller 552 and motor driver 554 to energize pulse motor 220 and clutch 252 until belt-position sensor 182 detects mark 186, and when ADF CPU 550 stops rotating document-transporting belt 180, brake 260 is energized for a predetermined time period (see FIG. 9(*a*)) (steps ST35 and ST36).

After that, ADF CPU 550 causes mechanical controller 552 and motor driver 554 to energize pulse motor 220, clutch 252, clutch 282, and gate solenoid 354 so that the leading edge of the sheet of original D corresponds to mark 186 (see FIG. 9(*b*)) (step ST37). The sheet of original D is transported by document-transporting belt 180, and reaches document-transporting rollers 200. Document-transporting rollers 200 transport the sheet transported by document-transporting belt 180 to document-transporting belt 180 again while gate 208 guides it (see FIG. 9(*c*)). ADF CPU 550 causes motor driver 554 to energize pulse motor 220 so as to rotate in the reverse direction when 100 msec has elapsed after document-detecting sensor 204 is turned on by the sheet of original D (steps ST38 to ST40). In this embodiment, the time period is 100 msec at step ST39. The time period, however, should be set properly corresponding to the transporting speed of automatic-document feeder 4 and the size of the sheet of original D so that the trailing edge of the sheet of original D corresponds to mark 186 after turning over.

ADF CPU 550 causes mechanical controller 552 and motor driver 554 to stop energizing pulse motor 220, clutch 252, clutch 282, and gate solenoid 354, and to energize brake 260 for a predetermined time period, so as to stop rotating document-transporting belt 180 when 500 msec has elapsed after document-detecting sensor 204 is turned on (see FIG. 9(*d*)) (steps ST41 and ST42). The 500 msec is the time period for which document-transporting rollers 200 and document-transporting belt 180 take to transport the sheet of original D from document-detecting sensor 204 to scale 14. Therefore, the time period depends on the transporting speed. Brake 260 is energized at the same time as clutch 252 is turned off. Thus, brake 260 prevents document-transporting belt 180 from racing and scrubbing the opposite surface.

After step ST42, ADF CPU 550 sends the first state signal to main CPU 500, main CPU 500 performs the copying operation like step ST19 (step ST43).

After the copying operation, main CPU 500 sends the second state signal to ADF CPU 550. ADF CPU 550 causes mechanical controller 552 and motor driver 554 to energize pulse motor 202, clutch 252, and gate solenoid 354 so as to turn over the sheet of original D and make a copy like steps ST38 to ST43 (steps ST44 to ST50).

After step ST50, ADF CPU 550 causes mechanical controller 552 and motor driver 554 to energize pulse motor 220 and clutch 252 so as to discharge the sheet of original D like steps ST20 to ST22 (steps ST51 to ST53). Then, ADF CPU 550 checks whether document-detecting sensor 168 is turned on (step ST54). If ADF CPU 550 determines that document-detecting sensor 168 is turned on, the flow chart returns to step ST30. If ADF CPU 550 determines that document-detecting sensor 168 is not turned on, the flow chart returns to step ST24.

If main CPU 500 determines that there is an image on the opposite surface, then main CPU 500 causes ADF CPU 550 to rotate document-transporting belt 180 until belt-position sensor 182 detects mark 186 like steps ST34 to ST36 (steps ST60 to ST62). Next, the sheet of original is transported and positioned on platen 12 like steps ST14 to ST18 (steps ST63 to ST67). Copying machine 2 makes a copy on the basis of the original image of the sheet of original D like step ST19 (step ST68). After that, automatic-document feeder 4 discharges the sheet of original D like steps ST20 to ST22 (steps ST69 to ST71). Then, ADF CPU 550 checks whether document-detecting sensor 168 is turned on (step ST72). If ADF CPU 550 determines that document-detecting sensor 168 is turned on, the flow chart returns to step ST15. If ADF CPU 550 determines that document-detecting sensor 168 is not turned on, the flow chart returns to step ST24.

Figure 10:
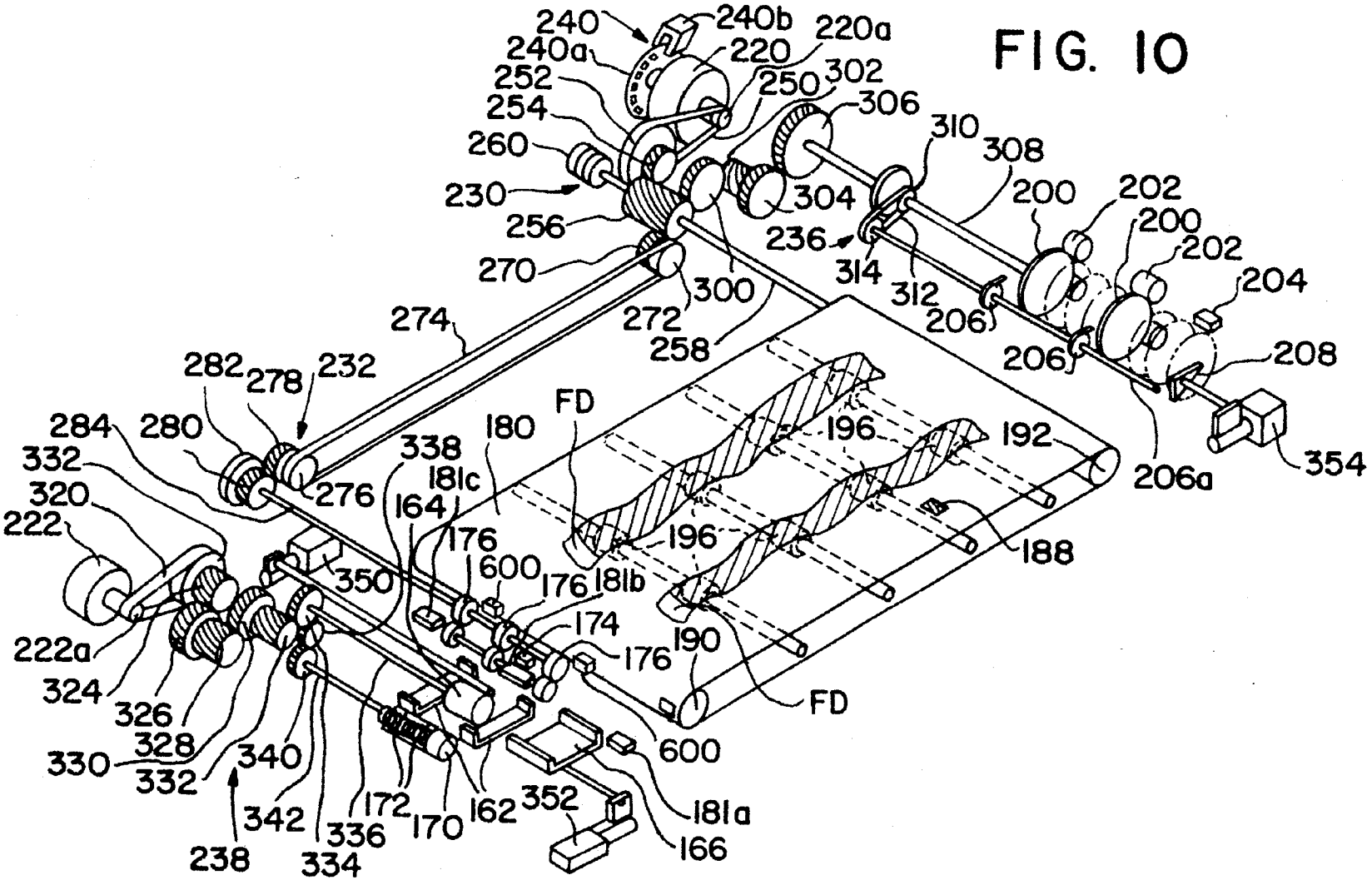
FIG. 10 is a perspective view schematically showing a transporting mechanism of an automatic-document feeder of a second embodiment.

FIG. 10 shows a second embodiment in relation to a structure of automatic-document feeder 4. In this embodiment, each belt position sensor 600 is arranged in automatic-document feeder 4 so as to face a specific portion of document-transporting belt 180. The specific portion is pressed against a sheet of original D on platen 12 by belt-retaining rollers 196. Thus, the specific portion gets dirty as document-transporting belt 180 transports a sheet of original D. Belt-position sensor 600 detects a first dirty area FD whose degree of dirtiness reaches a predetermined level. Thereafter, the area where belt-position sensor 600 detects is the same place in every rotation of document-transporting belt 180. Therefore, the first specific area which begins from the first dirty area FD is automatically defined. Besides, if belt-position sensor 600 does not detect first dirty area FD because the degree of dirtiness is less than the predetermined level, the detecting operation of belt-position sensor 600 is stopped when document-transporting belt 180 has made one revolution. In this embodiment, the mark is not formed on document-transporting belt 180 in advance, and the production cost may decrease.

Figure 11A:
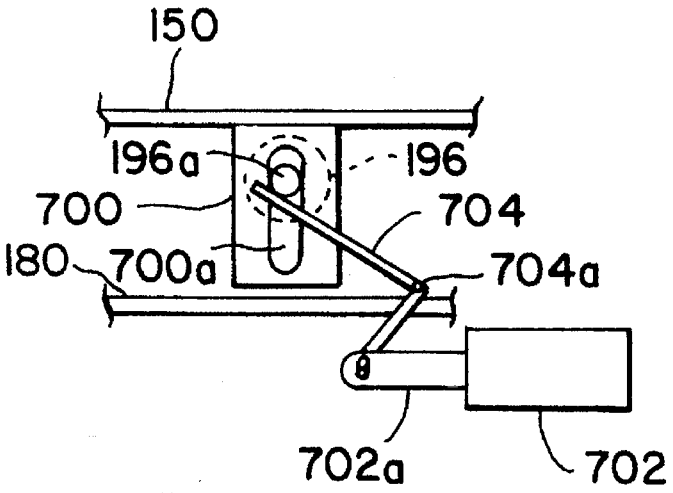
FIGS. 11(*a*) and 11(*b*) are side views showing a mechanism for moving belt-retaining rollers vertically in an automatic-document feeder of a third embodiment.
Figure 11B:
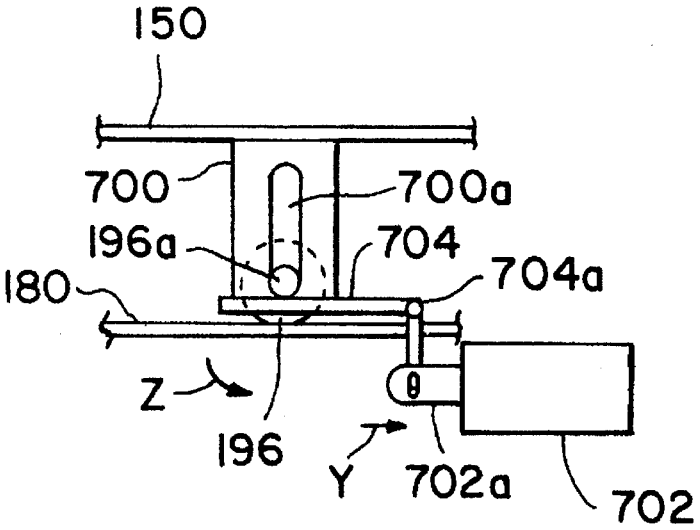

FIGS. 11(*a*) and 11(*b*) show a third embodiment in relation to a structure of automatic-document feeder 4. In this embodiment, automatic-document feeder 4 has a mechanism for moving belt-retaining rollers 196 vertically.

The mechanism includes metal plates 700 (only one shown), fixed on housing 150, a solenoid 702, and levers 704 (only one shown), arranged between rotational axes 196*a* (only one shown) of belt-retaining rollers 196 and an actuator 702*a* of solenoid 702. An oval-shaped aperture 700*a* movably supports rollers 196 in a vertical direction. Lever 704 rotates around a rotating axis 704*a*. When solenoid 702 is energized, actuator 702*a* moves in the direction of arrow Y, and lever 704 rotates in the direction of arrow Z. Then, belt-retaining rollers 196 press document-transporting belt 180 against platen 12. Solenoid 702 is energized only when document-transporting belt 180 is rotated to transport the original D. Thus, the mechanism prevents document-transporting belt 180 from getting dirty soon.

The present invention may be embodied in other specific forms without departing from the spirit or essential characteristics thereof. The presently described embodiments are therefore to be considered in all respects as illustrative and not restrictive. The scope of the present invention is indicated by the appended claims rather than by the foregoing description, and all changes which come within the meaning and range of equivalency of the claims are therefore intended to be embraced therein.

What is claimed is:

1. An automatic-document feeder for transporting an original from an original receiving portion to a scanned area in which the original is scanned, comprising:

means for picking up the original placed on the original receiving portion;

a document-transporting belt, arranged so as to cover the scanned area, for transporting the original picked up by the picking-up means by contacting an opposite surface of the original which does not face the scanned area so as to position the original on the scanned area;

means for determining that the original picked up has an image on the opposite surface; and means for driving the document-transporting belt to transport the original so that a first specific area and a second specific area are formed in the document-transporting belt, the first specific area contacting the opposite surface when the determining means determines that the original has an image on the opposite surface, the second specific area contacting the opposite surface when the original does not have an image on the opposite surface.

2. An automatic-document feeder according to claim 1, wherein the determining means comprises means for detecting that the original transported has an image on the opposite surface.

3. An automatic-document feeder according to claim 1, wherein the determining means comprises means for setting a specific mode in which a two-sided original is used.

4. An automatic-document feeder according to claim 3, further comprising means for turning over the original so that both sides of the original face a platen when the specific mode is set.

5. An automatic-document feeder according to claim 4, further comprising means for controlling the driving means so that the original contacts the first specific area after the turning-over means turns over the original.

6. An automatic-document feeder according to claim 1, wherein the driving means comprises a first mark formed on a one end of the first specific area of the document-transporting belt, means for detecting the first mark, and means for transporting the original to the document-transporting belt on the basis of the detecting operation of the detecting means so that a one end of the original corresponds to the first mark.

7. An automatic-document feeder according to claim 1, further comprising a retaining roller for pressing the document-transporting belt against the scanned area when the document-transporting belt transports the original.

8. An automatic-document feeder according to claim 7, further comprising means for supporting the retaining roller so that the retaining roller presses the document-transporting belt only when the document-transporting belt transports the original.

9. An image-forming apparatus, comprising:

a platen on which an original having an original image is placed, the platen being made from transparent material;

an automatic-document feeder, arranged on the platen, for transporting the original from an original receiving portion onto the platen and for discharging the original from the platen;

an exposure lamp for exposing the platen to form a reflected light, the reflected light including a light reflected by the original when the original is on the platen; and an image-forming portion for forming a copy image on an image-bearing member on the basis of the reflected light;

the automatic-document feeder comprising, means for picking up the original placed on the original receiving portion, a document-transporting belt, arranged so as to cover the platen, for transporting the original picked up by the picking-up means by contacting an opposite surface of the original which does not face the platen so as to position the original on the platen, means for determining that the original picked up has an image on the opposite surface, and means for driving the document-transporting belt to transport the original so that a first specific area and a second specific area are formed in the document-transporting belt, the first specific area contacting the opposite surface when the determining means determines that the original has an image on the opposite surface, the second specific area contacting the opposite surface when the original does not have an image on the opposite surface.

10. An image-forming apparatus according to claim 9, wherein the determining means comprises means for detecting that the original transported has an image on the opposite surface.

11. An image-forming apparatus according to claim 9, wherein the determining means comprises means for setting a specific mode in which a two-sided original is used.

12. An image-forming apparatus according to claim 11, further comprising means for turning over the original so that both sides of the original face the platen when the specific mode is set.

13. An image-forming apparatus according to claim 12, further comprising means for controlling the driving means so that the original contacts the first specific area after the turning-over means turns over the original.

14. An image-forming apparatus according to claim 9, wherein the driving means comprises a first mark formed on a one end of the first specific area of the document-transporting belt, first detecting means for detecting the first mark, and means for transporting the original to the document-transporting belt on the basis of the detecting operation of the first detecting means so that a one end of the original corresponds to the first mark.

15. An image-forming apparatus according to claim 9, further comprising second determining means for determining in advance of the image-forming operation that the reflected light includes a light reflected by the document-transporting belt.

16. An image-forming apparatus according to claim 15, wherein the driving means comprises means for transporting the original to the document-transporting belt so that the opposite surface contacts the second specific area when the determining means does not determine that the original has an image on the opposite surface and the second determining means determines that the reflected light includes the light reflected by the document-transporting belt.

17. An image-forming apparatus according to claim 16, wherein the driving means comprises a second mark formed on a one end of the second specific area of the document-transporting belt, and second detecting means for detecting the second mark, and the transporting means transports the original to the document-transporting belt on the basis of the detecting operation of the second detecting means so that a one end of the original corresponds to the second mark.

18. An image-forming apparatus according to claim 9, wherein the second specific area is larger than the maximum size of the original to be treated.

19. An image-forming apparatus according to claim 18, further comprising a hinge for supporting the automatic-document feeder so as to be removable and positionable to cover or not cover the platen.

20. An image-forming apparatus according to claim 19, further comprising means for controlling the driving means so that the second specific area faces the platen after the original has been discharged.

21. An image-forming apparatus according to claim 9, wherein the automatic-document feeder comprises a retaining roller for pressing the document-transporting belt against the platen when the document-transporting belt transports the original.

22. An image-forming apparatus according to claim 21, wherein the automatic-document feeder comprises means for supporting the retaining roller so that the retaining roller presses the document-transporting belt only when the document-transporting belt transports the original.

23. An automatic-document feeding method for transporting an original from an original receiving portion to a scanned area in which the original is scanned, comprising the steps of:

picking up an original placed on an original receiving portion;

determining that the original picked up has an image on an opposite surface;

transporting the original picked up using a document-transporting belt so as to position the original on the scanned area, the document-transporting belt being arranged so as to cover the scanned area and contacting the opposite surface during transporting the original; and driving the document-transporting belt to transport the original so that a first specific area and a second specific area are formed in the document-transporting belt, the first specific area contacting the opposite surface when the original has an image on the opposite surface, the second specific area contacting the opposite surface when the original does not have an image on the opposite surface.

24. An image-forming method, comprising the steps of:

picking up an original placed on an original receiving portion;

determining that the original picked up has an image on an opposite surface;

transporting the original picked up using a document-transporting belt so as to position the original on a platen made from transparent material, the document-transporting belt being arranged so as to cover the platen and contacting the opposite surface during transporting the original;

driving the document-transporting belt to transport the original so that a first specific area and a second specific area are formed in the document-transporting belt, the first specific area contacting the opposite surface when the original has an image on the opposite surface, the second specific area contacting the opposite surface when the original does not have an image on the opposite surface;

exposing the platen to form a reflected light, the reflected light including a light reflected by the original when the original is on the platen; and forming a copy image on an image-bearing member on the basis of the reflected light.

* * * * *